US010052687B2

(12) United States Patent
Quinn et al.

(10) Patent No.: US 10,052,687 B2
(45) Date of Patent: Aug. 21, 2018

(54) LADLE SHROUD FOR CASTING METAL, KIT OF PARTS FOR COUPLING ASSEMBLY FOR COUPLING SAID LADLE SHROUD TO A LADLE, METAL CASTING INSTALLATION AND COUPLING PROCESS

(71) Applicant: VESUVIUS GROUP, S.A., Ghlin (BE)

(72) Inventors: Jason Quinn, Mahomet, IL (US); Fabrice Sibiet, Ghlin (BE); Yannick Vasselin, Ghlin (BE)

(73) Assignee: Vesuvius Group, S.A., Rue de Douvrain, Ghlin, Toll (BE)

( * ) Notice: Subject to any disclaimer, the term of this patent is extended or adjusted under 35 U.S.C. 154(b) by 53 days.

(21) Appl. No.: 15/120,351

(22) PCT Filed: Feb. 17, 2015

(86) PCT No.: PCT/EP2015/053313
§ 371 (c)(1),
(2) Date: Aug. 19, 2016

(87) PCT Pub. No.: WO2015/124567
PCT Pub. Date: Aug. 27, 2015

(65) Prior Publication Data

US 2017/0066048 A1 Mar. 9, 2017

(30) Foreign Application Priority Data

Feb. 19, 2014 (EP) ..... 14155819

(51) Int. Cl.
*B22D 41/56* (2006.01)
*B22D 41/34* (2006.01)

(52) U.S. Cl.
CPC ..... *B22D 41/56* (2013.01); *B22D 41/34* (2013.01)

(58) Field of Classification Search
CPC ..... B22D 41/56; B22D 41/34
(Continued)

(56) References Cited

U.S. PATENT DOCUMENTS 4,262,827 A * 4/1981 DeMasi ..... B22D 41/56 164/337
2011/0240248 A1 10/2011 Yamauti et al.
(Continued)

FOREIGN PATENT DOCUMENTS

EP 2269751 A1 1/2011
EP 2368654 A1 9/2011
(Continued)

*Primary Examiner* — Scott R Kastler
(74) *Attorney, Agent, or Firm* — Thomas Clinton; Donald M. Satina

(57) ABSTRACT

A metal casting installation comprises a ladle comprising an inner nozzle in fluid communication with the through-opening of a top gate plate. The installation contains a ladle shroud coupling assembly comprising a support frame comprising a bottom gate plate and a passage. The support frame is slidingly coupled to a planar bottom surface of a top gate plate of the inner nozzle of the ladle, such that the opening of the bottom gate plate can be brought in or out of registry with the through-opening of the top gate plate. A drawer frame can be can be moved through the passage of the support frame. The bore of a specifically designed ladle shroud capable of being reversibly coupled to latches can be brought into or out of registry with the opening of the bottom gate plate.

16 Claims, 12 Drawing Sheets

(58) Field of Classification Search
USPC ..... 222/607
See application file for complete search history.

(56) References Cited

U.S. PATENT DOCUMENTS

| | | | | |
|---|---|---|---|---|
| 2016/0263651 | A1* | 9/2016 | Collura | B22D 41/502 |
| 2017/0066048 | A1* | 3/2017 | Quinn | B22D 41/34 |
| 2017/0120325 | A1* | 5/2017 | McKillen | B22D 41/50 |

FOREIGN PATENT DOCUMENTS

| | | | |
|---|---|---|---|
| JP | S09-108825 | A | 4/1997 |
| JP | S09-201657 | A | 5/1997 |
| JP | 2005211905 | A | 8/2005 |
| WO | 2004052576 | A1 | 6/2004 |
| WO | 2010057638 | A1 | 5/2010 |
| WO | 2011113597 | A1 | 9/2011 |
| WO | 2011113599 | A1 | 9/2011 |
| WO | 2013000566 | A1 | 1/2013 |

* cited by examiner

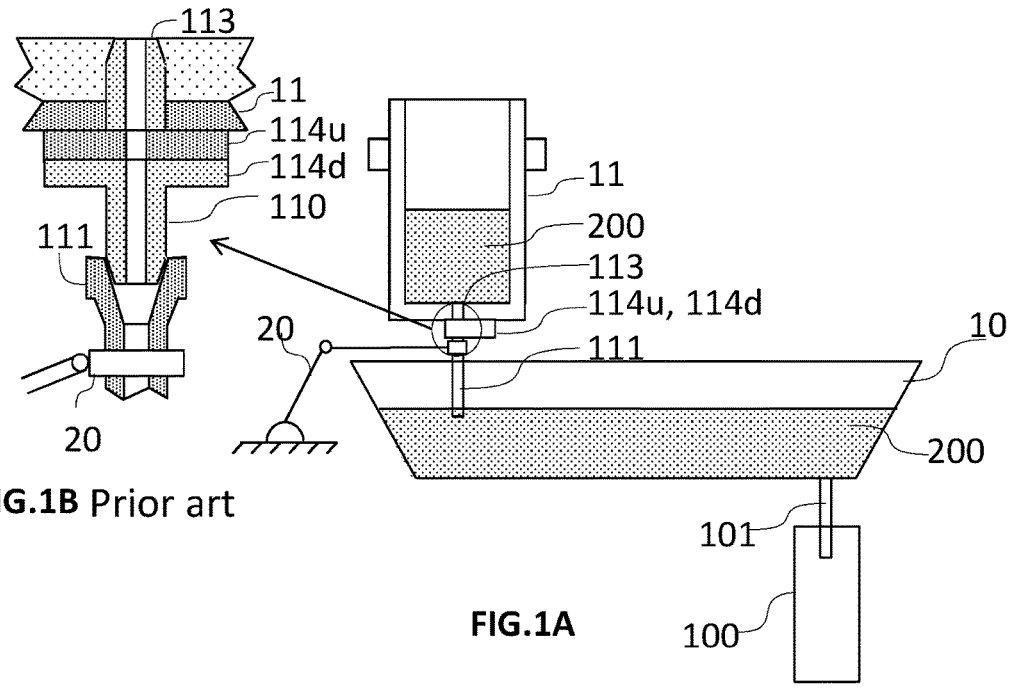
FIG.1B Prior art
FIG.1A
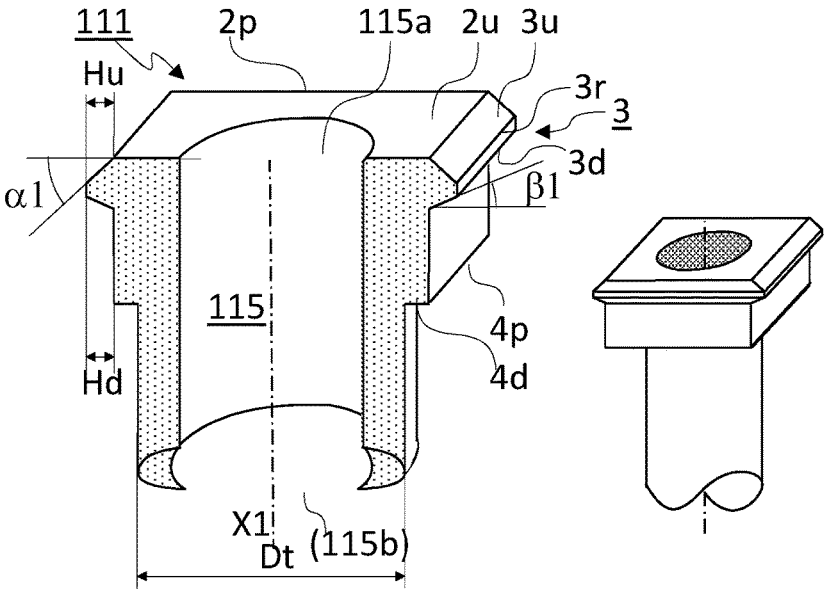
FIG.2A

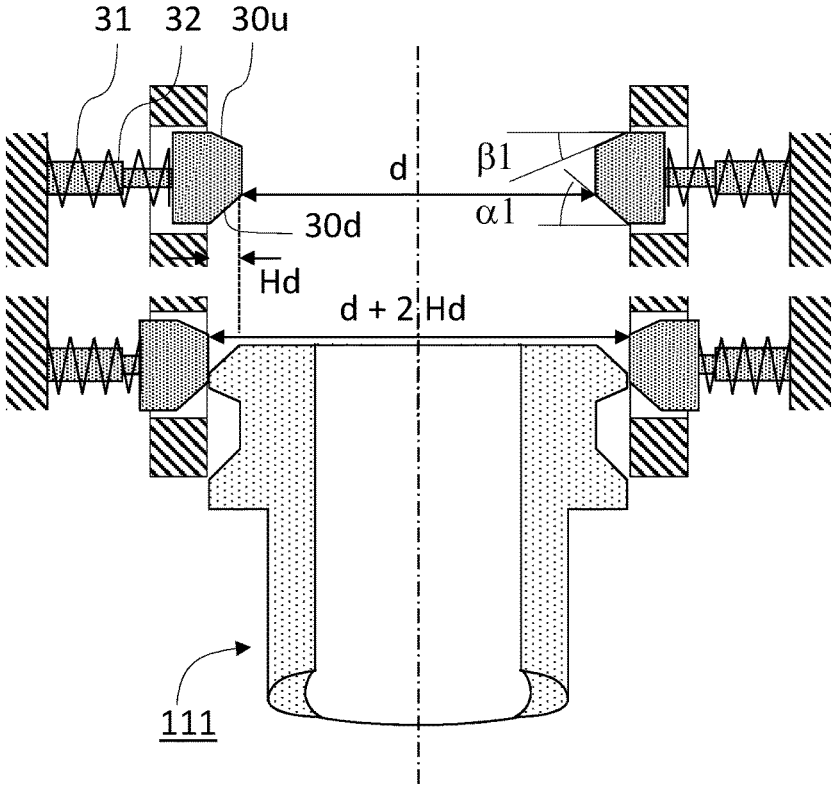
FIG.9
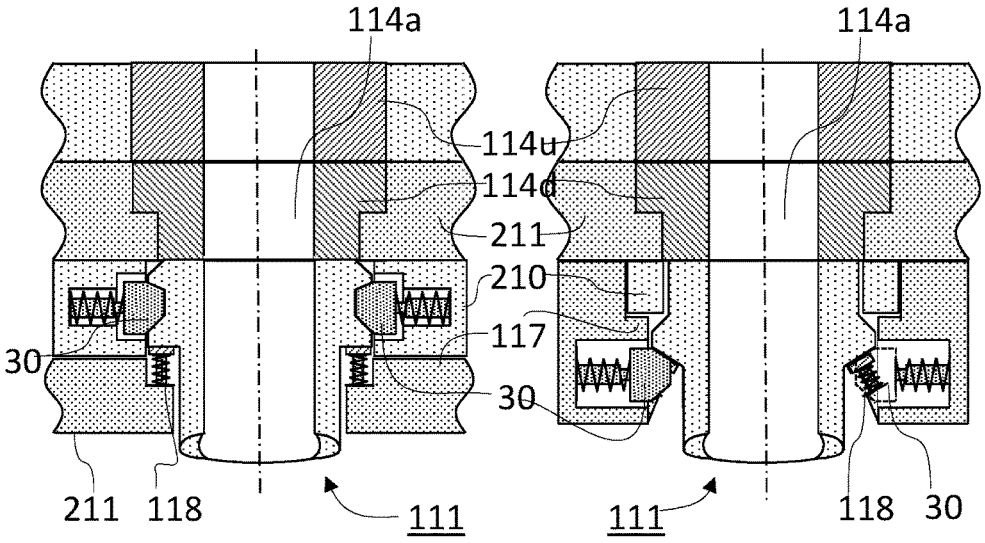
FIG.10A
FIG.10B

LADLE SHROUD FOR CASTING METAL, KIT OF PARTS FOR COUPLING ASSEMBLY FOR COUPLING SAID LADLE SHROUD TO A LADLE, METAL CASTING INSTALLATION AND COUPLING PROCESS

BACKGROUND OF THE INVENTION (1) Field of the Invention

The present invention relates to nozzles for coupling to a ladle in a metal casting installation (in particular to a steel casting installation), referred to as ladle shrouds. In particular, it relates to ladle shrouds which can be loaded to and unloaded from the bottom base of a ladle, slipped into casting position and which can maintain their casting position without any external means such as a manipulator or a robot. The present invention also concerns a kit of part for a coupling assembly allowing such reversible coupling, a metal casting installation comprising such nozzle, and a process of coupling a ladle shroud to the bottom base of a ladle.

(2) Description of the Related Art

In metal forming processes, molten metal is transferred from one metallurgical vessel to another, to a mould or to a tool. For example, as shown in FIGS. 1A and 1B a ladle (11) is filled with molten metal out of a furnace and transferred over a tundish (10) to cast the molten metal through a ladle shroud (111) into said tundish. The molten metal can then be cast through a pouring nozzle (101) from the tundish to a mould for forming slabs, billets, beams or ingots. Flow of molten metal out of a metallurgic vessel is driven by gravity through a nozzle system (101, 111) located at the bottom of said vessel.

In particular, the inner surface of the bottom floor of a ladle (11) is provided with an inner nozzle (113) comprising an inner bore. The outlet end (113*b*) of said inner nozzle is coupled to a gate (114*u*, 114*d*), generally a sliding gate or a rotary gate, controlling the flow of molten metal out of the ladle. In order to protect the molten metal from oxidation as it flows from the ladle to a tundish (10), a ladle shroud (111) is brought in fluid communication (via its upper end) with the outlet end of the inner nozzle while its lower end is immersed into the tundish, generally below the level of molten metal; to form a continuous molten metal flow path shielded from any contact with oxygen between the inlet end (113*a*) of the inner nozzle (113) within the ladle down to the outlet of the ladle shroud immersed in the liquid metal contained in the tundish. A ladle shroud is simply a nozzle comprising a long tubular portion crowned by an upstream coupling portion with a central bore. In many cases, the ladle shroud is inserted about and sealed to a short collector nozzle (110) coupled to, and jutting out of the outer surface of the ladle bottom floor, and which is separated from the inner nozzle (113) by a gate (114*u*, 114*d*).

In practice, a ladle is brought to its casting position over a tundish or a mould from a furnace, a converter or another ladle where it was filled with a batch of molten metal, with the gate (114*u*, 114*d*) in a closed configuration. During its trips from the furnace, converter or other ladle to the casting position over a tundish and back, the ladle is not coupled to any ladle shroud (111) because the latter is long and it would be dangerous to move a ladle back and forth across a workshop with a long ladle shroud jutting out of its lower base. Once the ladle is at its casting position above a tundish (10), a manipulator or a robot (20) brings a ladle shroud into casting configuration. As shown in FIG. 1B, in traditional casting installations, the outlet end of the collector nozzle (110) is snugly nested in the bore inlet of the ladle shroud to form a sealing joint. The manipulator or robot (20) must maintain the ladle shroud (111) in its casting configuration during the whole casting of the molten metal batch contained in the ladle (11). When the ladle is empty, the gate is closed and the manipulator or robot takes back the ladle shroud to allow the removal of the empty ladle and replacement by another ladle filled with a new batch of molten metal. The manipulator or robot (20) repeats the foregoing operations with the new ladle and the same or a new ladle shroud. The manipulator or robot (20) must be operational during the whole duration of the casting of molten metal from the ladle into a tundish, and cannot be used in the meantime for other operations, such as measurements of various process parameters, removal of a clogging in the inner nozzle and the like.

Emergencies may happen, with the gate not functioning properly, requiring the swift removal of the ladle from its casting position to empty the remaining content of molten metal into an appropriate emergency waste area. If the collector nozzle of the ladle (110) is nested in the bore of the ladle shroud (111) with the manipulator or robot firmly gripping the latter in its casting configuration (cf. FIG. 1B), the emergency removal of the ladle would drag therewith both ladle shroud and manipulator or robot, causing serious damages to the installation. Indeed, the manipulator or robot cannot be dragged very far, and the ladle may be blocked halfway, casting molten metal in an inappropriate area of the workshop causing serious consequences and danger.

To prevent such accidents to occur, specific ladle shrouds and coupling mechanisms comprising means for holding them in casting configuration without the need of a manipulator or robot have been proposed in the art. This way, the swift removal of a ladle would certainly break the ladle shroud, but would not drag and be stopped by a bulky (and expensive) manipulator or robot in its run.

For example, JPS09-201657 proposes a ladle shroud provided with coupling means including a bayonet requiring the rotation of the nozzle about its longitudinal axis to block it in its casting configuration. Such rotation can become very difficult as soon as the slightest amount of molten metal flows into and jags the bayonet mechanism upon freezing. Alternatively, JPS09-108825 proposes a ladle shroud comprising two pins on either side thereof suitable for being held in casting configuration by a moving bracket comprising complementary slots for receiving said pins. This mechanism requires an excellent coordination between the loading of a ladle shroud onto the slots of the brackets, and the tilting of the latter in a clamping configuration.

Once a ladle loaded with a fresh batch of molten metal is brought into casting position, it is not always straightforward to initiate the discharge of molten metal into a tundish by opening the gate (114*u*, 114*d*). Indeed, when molten metal contacts the relatively cold walls of the vessel it may freeze forming a solid layer against the walls. The freezing of molten metal should be avoided by all means at the levels of the nozzle system and gate, lest the casting operation should be interrupted to unclog the system. Static molten metal has plenty of time to freeze in place at the gate during the transfer of the ladle. For this reason, a plugging material (300), usually sand, is often used to fill the bore of the inner nozzle from its inlet to the closed gate to prevent any molten metal from flowing therein, such that metal freezing and clogging of the nozzle and gate system are prevented. Upon opening the gate, the plugging material flows out followed by the molten metal thus preventing any metal from dwelling and freezing in the inner nozzle (113).

A solid crust of sintered sand impregnated with frozen metal usually forms at the interface between molten metal and sand. In most cases, the crust is thin enough to break under the own weight of molten metal upon opening the gate. Sometimes, however, it may happen that the crust is hard enough to resist the weight of the molten metal. The crust must then be broken or fused with a tool or torch handled manually or with a robot. Because of the length of a ladle shroud, this operation is very cumbersome if the ladle shroud is already coupled to the collector nozzle of the ladle. If the crust resists, a ladle shroud in a traditional installation such as illustrated in FIG. 1B must be de-coupled from the collector nozzle, the crust broken or molten with a torch to initiate the casting of molten metal. Coupling the ladle shroud again to the collector nozzle as metal is flowing through the collector nozzle is dangerous as spilling of molten metal is unavoidable.

To eliminate the need of such dangerous operation, a device for inserting and removing ladle nozzles was proposed in WO2004/052576. Though solving a number of the problems discussed above, said device is, however, cumbersome to operate. The device is rather large in size and does not provide the necessary visibility to permit an operator to work with the high precision required for the installation of a ladle shroud. For example, the lack of clearance with the tilting bar and ribs of the ladle and also between the bottom of the tube and the tundish is a drawback of said coupling assembly.

The present invention proposes a solution solving all the issues raised above, such as providing a ladle shroud that can be inserted and removed easily, which holds in place without the need of any exterior manipulator or robot, and which allows the coupling to a ladle of a short collector nozzle upon initiation of the casting followed by the replacement thereof without spilling of molten metal by a long ladle shroud once casting has successfully initiated. These and other advantages of the present invention are presented in the following sections.

BRIEF SUMMARY OF THE INVENTION

The present invention is defined in the appended independent claims. Selected embodiments are defined in the dependent claims and will be discussed hereafter in relation to the appended figures. In particular, the present invention concerns a shroud (111) for casting metal from a ladle (i.e. a ladle shroud), said nozzle comprising:

(a) a bore (115) extending parallel to a first longitudinal axis, X1, from an inlet orifice (115*a*) to an outlet orifice (115*b*), (b) an inlet portion located at an upstream end of the ladle shroud and consisting of a plate comprising:

- a planar upstream surface (2*u*) normal to said longitudinal axis, X1, said upstream surface comprising said inlet orifice (115*a*) and being defined by an upstream perimeter (2*p*),
- a downstream surface (4*d*) defined by a downstream perimeter (4*p*) and separated from the upstream surface by,
- a peripheral wall contiguous to both upstream (2*u*) and downstream (4*p*) perimeters defining the thickness of the plate at the level of the upstream perimeter (2*p*), and comprising at least a first and a second gripping portions separated from each other by the bore (115), (c) a tubular portion extending along said first longitudinal axis, X1, from said downstream surface (4*d*) of the inlet portion to a downstream end, opposite to the upstream end, and where said outlet orifice (115*b*) is located. The ladle shroud according to the invention is characterised in that, each of said first and second gripping portions of the peripheral wall comprises an upstream protrusion (3) culminating at an upstream ridge (3*r*) separating a leading edge (3*u*) facing towards the upstream end of the ladle shroud from a trailing edge (3*d*) facing towards the downstream end of the ladle shroud, and protruding out beyond the whole peripheral wall of the corresponding gripping portion, said upstream portions (3) extending parallel to the upstream surface (2*u*) and substantially symmetrically to one another with respect to the longitudinal axis, X1, along the respective first and second gripping portions. The ladle shroud according to the invention is further characterized in that,

- said leading edge (3*u*) forms with a plane parallel to the upstream surface an angle, $\alpha 1$, and
- said trailing edge (3*d*) forms an angle, $\beta 1$, with a plane parallel to the upstream surface (2*u*), wherein $|\alpha 1| \geq |\beta 1|$.

In the present document, the terms "upstream" and "downstream" are used with reference to the casting direction of the molten metal, i.e., "upstream" starting from the ladle (11) and "downstream" ending in the mould (100). In the following, the space is defined by an orthogonal vectorial system (X1, X2, X3), wherein X1 is the longitudinal axis or direction, X2 the first transverse axis or direction, and X3 the second transverse axis or direction. The longitudinal axis, X1, corresponds in use to a substantially vertical direction parallel to the flow direction of molten metal through the various nozzles. The directions, X2 and X3, therefore define a plane normal to the longitudinal direction, X1, and is substantially horizontal. The term "substantially" is used herein because in a workshop, it is impossible to ensure that a vessel such as a tundish is held perfectly horizontally, and consequently, the nozzles, though designed for being used vertically, can therefore often slightly deviate from verticality.

BRIEF DESCRIPTION OF THE SEVERAL VIEWS OF THE DRAWINGS

For a fuller understanding of the nature of the present invention, reference is made to the following detailed description taken in conjunction with the accompanying drawings in which:

FIG. 1A represents a general view of a casting installation for casting metal.

FIG 1B represents a ladle shroud in a casting installation for casting metal.

FIG. 2A shows a perspective full and cut-out view of a ladle shroud according to an embodiment of the present invention.

FIG. 9: shows the movement of the latches during loading of a ladle shroud.

FIG. 10A shows a ladle shroud in coupling position between two latches mounted on a drawer frame.

FIG. 10B shows a ladle shroud in coupling position between two latches mounted on a support frame.

DETAILED DESCRIPTION OF THE INVENTION

As illustrated in FIGS. 1A and 1B a ladle shroud (111) is to be coupled to a ladle (11) once the latter is in casting position above a tundish (10) or any other metallurgical vessel or mould. A ladle shroud is a long tube used for transferring molten metal from a ladle (11) to a tundish (10) (or other vessel) sheltered from any contact with air to prevent oxidation. As discussed in the introductory section, it is an object of the present invention to provide a ladle shroud which is easy to couple to the bottom base of a ladle (11) and which can be maintained in its casting position without any external tool such as a robot (20).

Figure 2B:
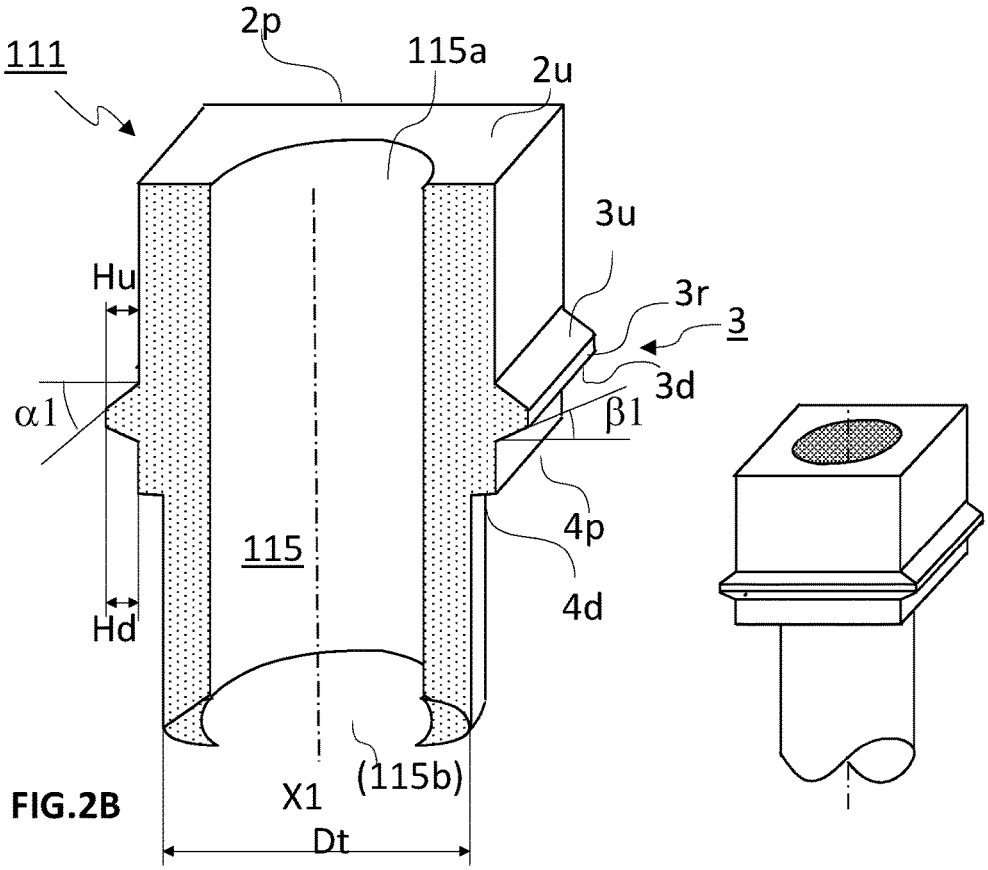
FIG. 2B shows a perspective full and cut-out view of a ladle shroud according to an embodiment of the present invention.
Figure 2C:
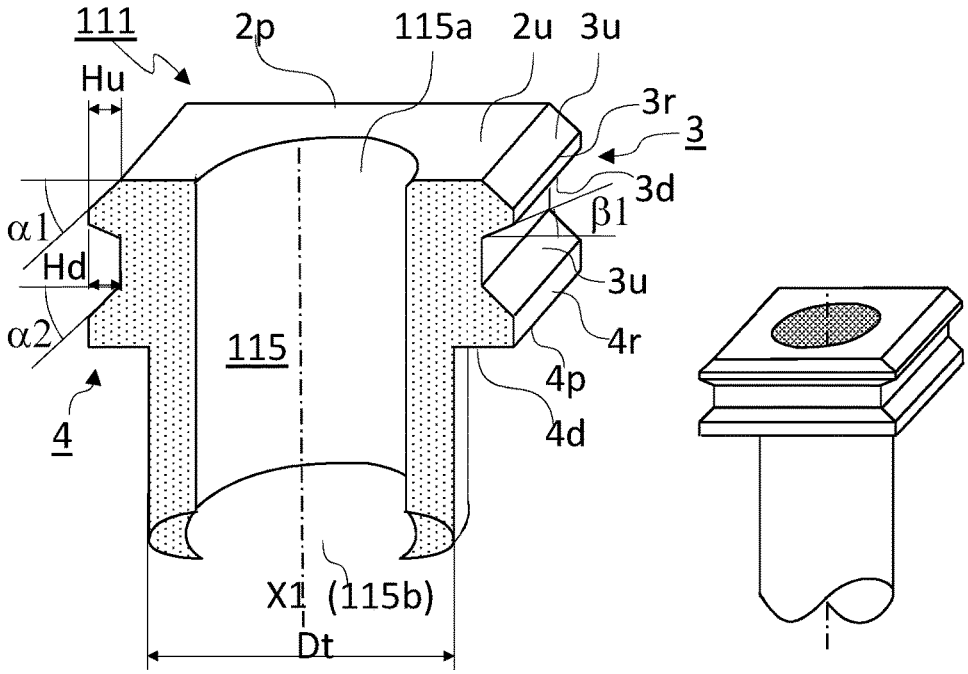
FIG. 2C shows a perspective full and cut-out view of a ladle shroud according to an embodiment of the present invention.

Like any ladle shrouds, a ladle shroud (111) according to the present invention comprises a bore (115) extending parallel to a first longitudinal axis, X1, from an inlet orifice (115*a*) to an outlet orifice (115*b*). As shown in FIG. 1B, the inlet portion located at an upstream end of prior art ladle shrouds which are to be mounted over a collector nozzle (110) in a nesting relationship, is characterized by a conically tapering bore ending in a circular ridge, designed for snugly fitting a similarly conically tapering portion of a collector nozzle. Sealing contact is ensured at the level of the matching conically tapered collector nozzle and inlet portion of the ladle shroud bore. By contrast, the sealing contact between a ladle (11) and a ladle shroud (111) according to the present invention is ensured by a planar upstream surface slidingly resting against a planar bottom surface of a bottom gate plate (114*d*) (see e.g., FIGS. 10A and 10B). For this reason and as illustrated in FIGS. 2A, 2B and 2C, the inlet portion of a ladle shroud according to the present invention consists of a plate comprising:

a planar upstream surface (2*u*) normal to said longitudinal axis, X1, said upstream surface comprising said inlet orifice (115*a*) and being defined by an upstream perimeter (2*p*), a peripheral wall defining the thickness of the plate at the level of the upstream perimeter (2*p*) and comprising at least a first and a second gripping portions separated from each other by the bore (115) which extend symmetrically to each other with respect to the longitudinal axis, X1, from corresponding portions of the upstream perimeter (2*p*) down to, a downstream surface (4*d*) separated from the upstream surface by the height of the peripheral wall and defined by a downstream perimeter (4*p*).

Downstream of the downstream surface (4*d*) of the plate, a ladle shroud according to the present invention comprises a tubular portion similar to prior art ladle shrouds, extending along said first longitudinal axis, X1, from said downstream surface (4*d*) to a downstream end, opposite the upstream end, and where said outlet orifice (115*b*) is located. The geometry of the tubular portion, such as its outer diameter, Dt, and of the bore in said tubular portion does not affect the present invention, and any desired shape of the tubular portion known in the art can be applied to a ladle shroud according to the present invention.

A ladle shroud (111) according to the present invention is characterized over the ladle shrouds of the prior art by the geometry of the inlet portion thereof. In particular, as shown in FIGS. 2A, 2B and 2C, each of said first and second gripping portions of the peripheral wall comprises an upstream protrusion (3) culminating at an upstream ridge (3*r*) separating a leading edge (3*u*) facing towards the upstream end of the ladle shroud from a trailing edge (3*d*) facing towards the downstream end of the ladle shroud. Said upstream protrusion (3) protrudes out beyond the whole peripheral wall of the corresponding gripping portion, said upstream portions (3) extending parallel to the upstream surface (2*u*) and substantially symmetrically to one another with respect to the longitudinal axis, X1, along the respective first and second gripping portions. The leading edge (3*u*) of the upstream protrusion forms with a plane parallel to the upstream surface an angle, $\alpha 1$, and the trailing edge (3*d*) forms an angle, $\beta 1$, with a plane parallel to the upstream surface (2*u*), wherein $|\alpha 1| \geq |\beta 1|$. The angle, $\alpha 1$, of the leading edge (3*u*) may be comprised between 45° and 70°, may be comprised from and including 55 to and including 65° and the angle, $\beta 1$, of the trailing edge (3*d*) may be smaller than the angle, $\alpha 1$, and may be comprised from and including 25° to and including 45°, or may be comprised from and including 35° and 40°. The relevance of the angles, $\alpha 1$ and $\beta 1$, of the leading edge and trailing edge of the upstream protrusion (3) will be discussed more in details below together with the drawing frame (210) and support frame (211) used to couple such ladle shroud (111) to a ladle (11).

In certain embodiments, the peripheral wall of the ladle shroud (111) comprises a third and a fourth gripping portions separated from each other by the bore (115) and extending symmetrically to each other with respect to the longitudinal axis, X1, from corresponding portions of the upstream perimeter (2*p*) down to corresponding portions of the downstream perimeter (4*p*). The third and fourth gripping portions may have the same geometry and dimensions as, and extending transverse, generally normal to the first and second gripping portions, and comprise an upstream protrusion (3) of same geometry as the one of the first and second gripping portions. The geometry may be a square upstream periphery (2*p*) with curved or straight edges, and with an upstream protrusion (3) as defined above extending along the whole peripheral wall parallel to the upstream surface (2*u*). This way, an operator needs not check the angular orientation about the longitudinal axis, X1, of the ladle shroud when handling it as any 90°-rotation thereof would thus offer an equivalent coupling configuration of the shroud. When the upstream surface (2*u*) must be planar, there is no particular requirement of planarity for any of the remaining surfaces defining the plate of a ladle shroud according to the present invention. In certain embodiments, the portions of the upstream perimeter (2*p*) and downstream perimeter (4*p*) corresponding to each of the first and second gripping portions are straight lines. Similarly, the leading edge (3*u*) and upstream ridge (3*r*) of the upstream protrusion (3), as well as the downstream surface (4*d*) may be at least partially planar, or may be fully planar.

The upstream protrusion (3) can be contiguous to the upstream surface (2*u*), the base of the leading edge (3*u*) thereof defining a section or the whole of the upstream perimeter (2*p*) as illustrated in FIG. 2A. Alternatively, as illustrated in FIG. 2B, the upstream protrusion (3) can be separated from the upstream perimeter (2*p*) by a portion of the peripheral wall. The exact position of the upstream protrusion (3) depends on the geometry of the drawer frame (210) and support frame (211) to which the ladle shroud (111) is to be coupled, and which are discussed more in details below. The upstream protrusion (3) normally is the first protrusion encountered when running the peripheral wall of the plate from the upstream surface (2*u*) down to the downstream surface (4*d*) thereof. The geometry of the upstream protrusion (3) is important as it must be configured for cooperating with latches mounted on a drawer frame (210) or a support frame (211), to maintain it coupled to the bottom base of a ladle, holding the ladle shroud own weight, while it is not in its casting position. The distance, Hu, from the upstream ridge (3*r*) of the upstream protrusion (3) to the bottom of the leading edge (3*u*) measured along a plane parallel to the upstream surface may be greater than 5 mm, or may be comprised from and including 6 mm to and including 15 mm, or may be comprised from and including 8 mm to and including 12 mm. The distance, Hd, from the upstream ridge (3*r*) of the upstream protrusion (3) to the bottom of the trailing edge (3*d*) measured along a plane parallel to the upstream surface is, on the other hand, equal or different from Hu, and may be greater than 5 mm, may be comprised from and including 6 mm to and including 15 mm, and may be comprised from and including 8 mm to and including 12 mm.

In an embodiment illustrated in FIG. 2C, each of the first and second gripping portions further comprises a downstream protrusion (4) culminating at a downstream ridge (4*r*) separating a leading edge (4*u*) facing towards the upstream protrusion (3) from the downstream surface (4*d*), and extending parallel to the upstream protrusion (3) along the respective first and second gripping portions. The upstream ridge (3*r*) and the downstream ridge (4*r*) are thus separated from one another by a recess. As discussed later, the trailing edge (3*d*) of the upstream protrusion (3), the leading edge (4*u*) of the downstream protrusion (4), and the recess separating the upstream from the downstream protrusions define a geometry that matches the profile of the latches (30) used to couple a ladle shroud to a ladle (11).

As shown in FIGS. 2A, 2B, 7, 8, 10A and 10B, the elements required for coupling a ladle shroud (111) according to the present invention to a ladle (11) comprise:

(a) a ladle shroud (111) as discussed above, (b) a drawer frame (210) for hosting the ladle shroud (111), (c) a support frame (211) for receiving and coupling the drawer frame (210) to the ladle (11), (d) a pair of resilient latches (30) mounted either on the drawer frame (210) or on the support frame (211), for holding the ladle shroud in the drawer frame when not in a casting position, (e) a gate comprising a top gate plate (114*u*) and a bottom gate plate (114*d*) for controlling the flow of molten metal out of the ladle (11), and (f) optionally, a collector nozzle (110).

Figure 3A:
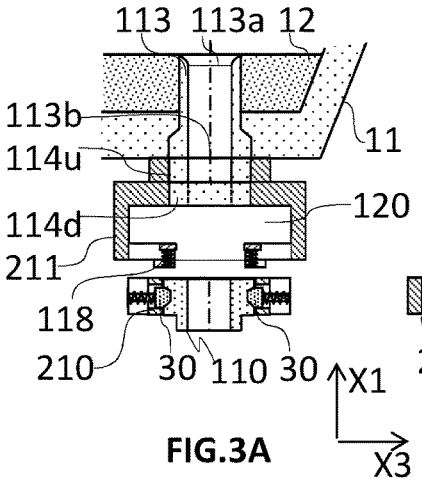
FIG. 3A shows a step in a sequence of loading a ladle shroud onto a drawer frame slidingly coupled to a support frame according to an embodiment of the present invention.
Figure 3B:
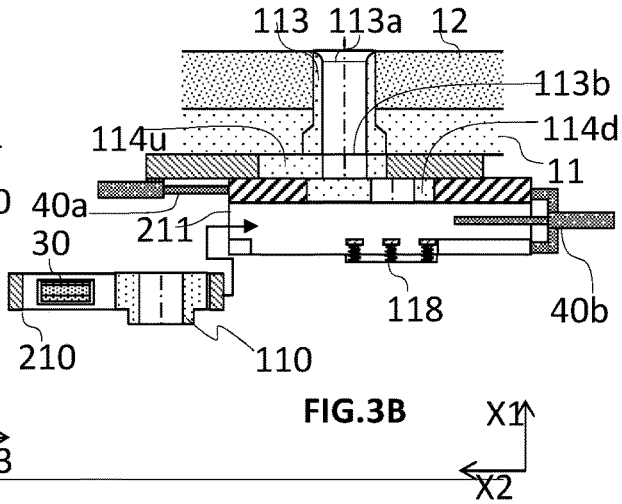
FIG. 3B shows a step in a sequence of loading a ladle shroud onto a drawer frame slidingly coupled to a support frame according to an embodiment of the present invention.
Figure 3C:
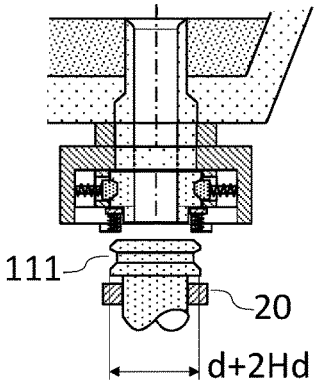
FIG. 3C shows a step in a sequence of loading a ladle shroud onto a drawer frame slidingly coupled to a support frame according to an embodiment of the present invention.
Figure 3D:
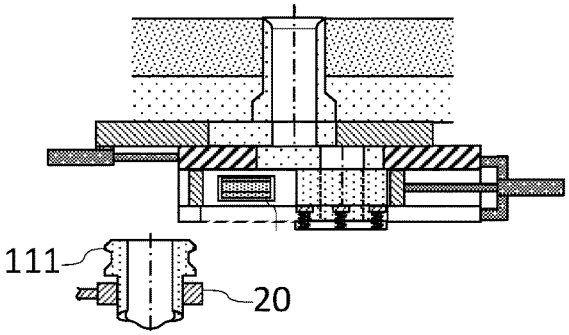
FIG. 3D shows a step in a sequence of loading a ladle shroud onto a drawer frame slidingly coupled to a support frame according to an embodiment of the present invention.
Figure 3E:
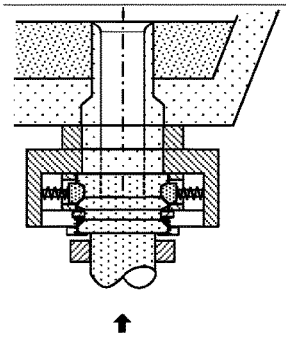
FIG. 3E shows a step in a sequence of loading a ladle shroud onto a drawer frame slidingly coupled to a support frame according to an embodiment of the present invention.
Figure 3F:
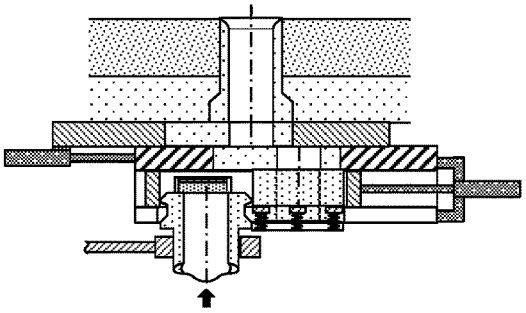
FIG. 3F shows a step in a sequence of loading a ladle shroud onto a drawer frame slidingly coupled to a support frame according to an embodiment of the present invention.
Figure 3G:
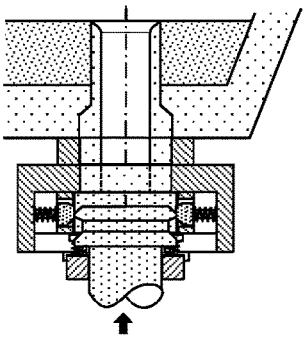
FIG. 3G shows a step in a sequence of loading a ladle shroud onto a drawer frame slidingly coupled to a support frame according to an embodiment of the present invention.
Figure 3H:
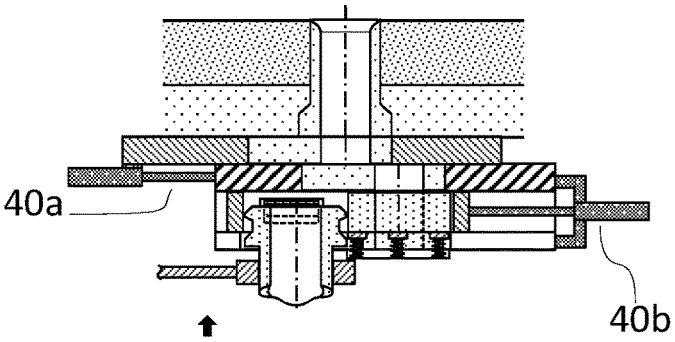
FIG. 3H shows a step in a sequence of loading a ladle shroud onto a drawer frame slidingly coupled to a support frame according to an embodiment of the present invention.
Figure 3I:
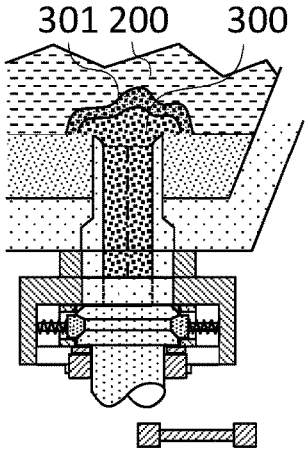
FIG. 3I shows a step in a sequence of loading a ladle shroud onto a drawer frame slidingly coupled to a support frame according to an embodiment of the present invention.
Figure 3J:
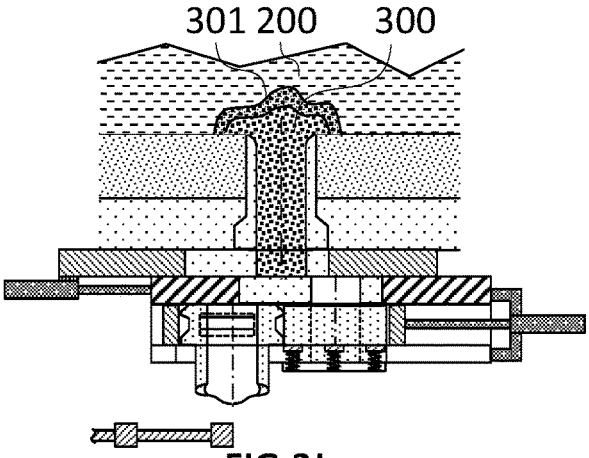
FIG. 3J shows a step in a sequence of loading a ladle shroud onto a drawer frame slidingly coupled to a support frame according to an embodiment of the present invention.
Figure 3K:
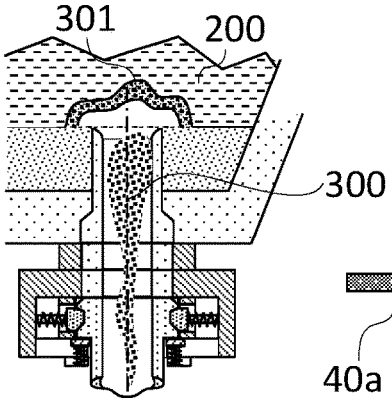
FIG. 3K shows a step in a sequence of loading a ladle shroud onto a drawer frame slidingly coupled to a support frame according to an embodiment of the present invention.
Figure 3L:
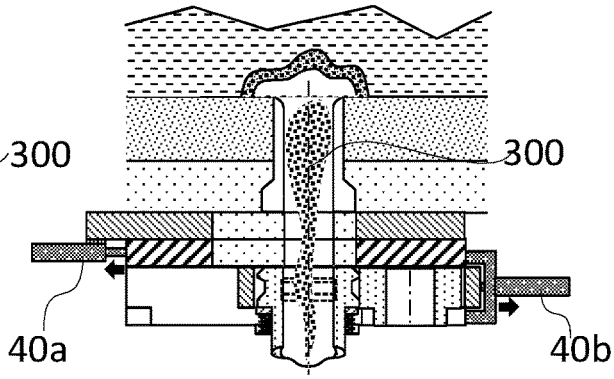
FIG. 3L shows a step in a sequence of loading a ladle shroud onto a drawer frame slidingly coupled to a support frame according to an embodiment of the present invention.
Figure 3M:
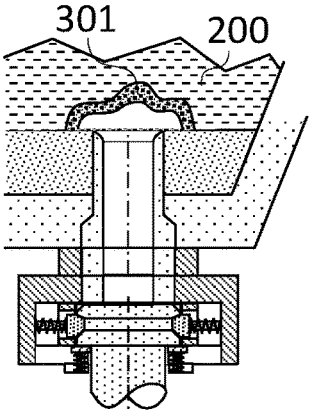
FIG. 3M shows a step in a sequence of loading a ladle shroud onto a drawer frame slidingly coupled to a support frame according to an embodiment of the present invention.
Figure 3N:
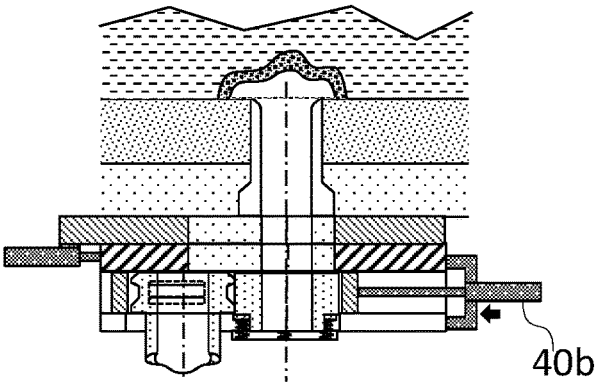
FIG. 3N shows a step in a sequence of loading a ladle shroud onto a drawer frame slidingly coupled to a support frame according to an embodiment of the present invention.
Figure 3O:
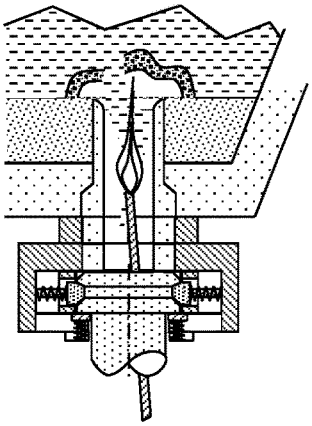
FIG. 3O shows a step in a sequence of loading a ladle shroud onto a drawer frame slidingly coupled to a support frame according to an embodiment of the present invention.
Figure 3P:
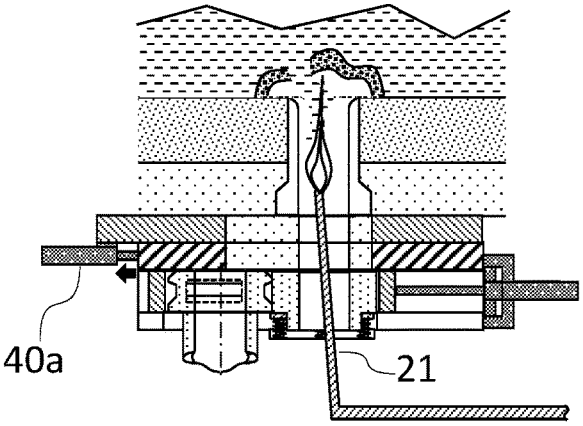
FIG. 3P shows a step in a sequence of loading a ladle shroud onto a drawer frame slidingly coupled to a support frame according to an embodiment of the present invention.
Figure 3Q:
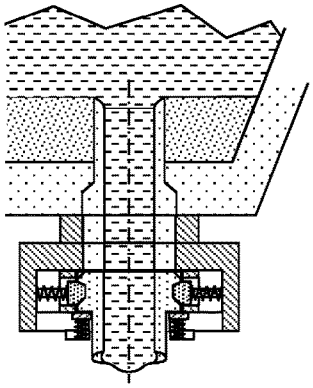
FIG. 3Q shows a step in a sequence of loading a ladle shroud onto a drawer frame slidingly coupled to a support frame according to an embodiment of the present invention.
Figure 3R:
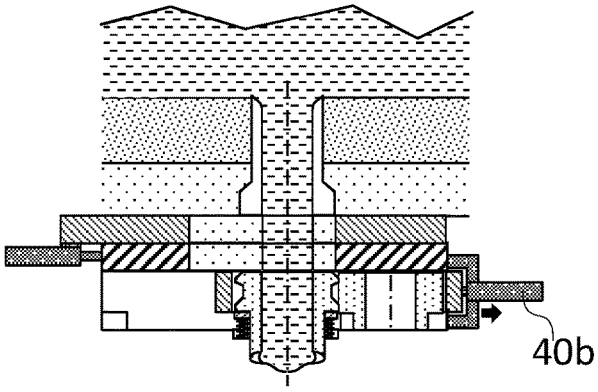
FIG. 3R shows a step in a sequence of loading a ladle shroud onto a drawer frame slidingly coupled to a support frame according to an embodiment of the present invention.
Figure 3S:
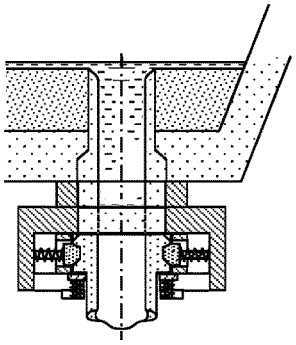
FIG. 3S shows a step in a sequence of loading a ladle shroud onto a drawer frame slidingly coupled to a support frame according to an embodiment of the present invention.
Figure 3T:
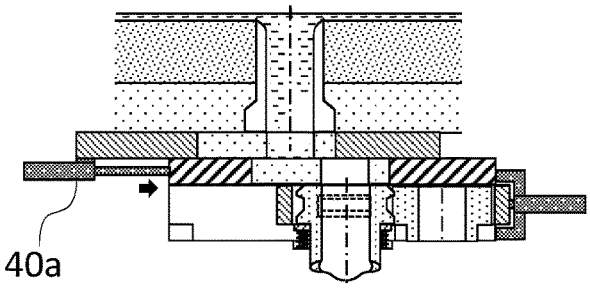
FIG. 3T shows a step in a sequence of loading a ladle shroud onto a drawer frame slidingly coupled to a support frame according to an embodiment of the present invention.
Figure 3U:
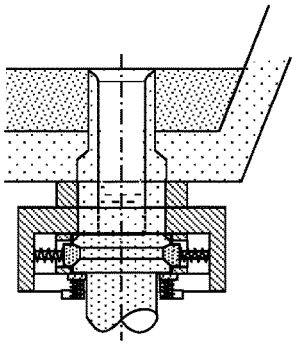
FIG. 3U shows a step in a sequence of loading a ladle shroud onto a drawer frame slidingly coupled to a support frame according to an embodiment of the present invention.
Figure 3V:
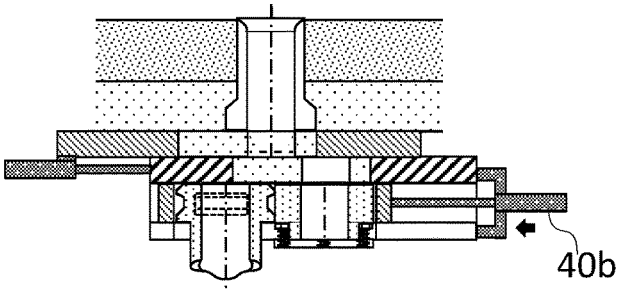
FIG. 3V shows a step in a sequence of loading a ladle shroud onto a drawer frame slidingly coupled to a support frame according to an embodiment of the present invention.
Figure 3W:
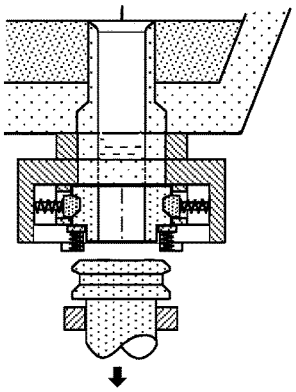
FIG. 3W shows a step in a sequence of loading a ladle shroud onto a drawer frame slidingly coupled to a support frame according to an embodiment of the present invention.
Figure 3X:
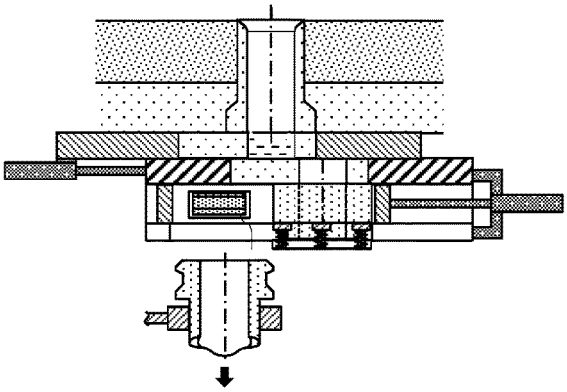
FIG. 3X shows a step in a sequence of loading a ladle shroud onto a drawer frame slidingly coupled to a support frame according to an embodiment of the present invention.

The gist of the invention is the combination of a pair of resilient latches (30) with the gripping portions of a ladle shroud (111) as discussed supra, wherein the latches (30) are configured for engaging the gripping portions of the ladle shroud (111). The resilient latches (30) must be configured for:

(a) allowing snap fitting engagement of the ladle shroud into a hanging position between the latches (cf. FIGS. 3E-3J, 9, 10A and 10B), (b) holding the ladle shroud own weight in its hanging position (cf. FIGS. 3I, 3J, 3M, 3N, 3O, 3P, 10A and 10B), (c) allowing the transfer of the ladle shroud from its hanging position to a casting position, wherein the bore (115) thereof is in registry with the opening (114*a*) of the lower gate plate (114*d*) of a gate (cf. FIGS. 3K, 3L, 3Q and 3R, (d) allowing the transfer of the ladle shroud from its casting position back to its hanging position between the latches (cf. FIGS. 3M, 3N, 3U and 3V, and (e) allowing disengagement of the ladle shroud from between the latches (cf. FIGS. 3W and 3X.

The assembly for coupling a ladle shroud (111) to a ladle (11) comprises a drawer frame (210) comprising two longitudinal beams (210*x*) extending along a first transverse axis, X2, separated from one another by two transverse beams (210*y*), thus defining a cavity of area and perimeter with a width and length measured along the first and second transverse axes, X2, X3, respectively, which are configured for snugly accommodating the equivalent of at least one inlet surface (2*u*) of a ladle shroud (111) as discussed above and illustrated in FIGS. 4A to 8. The transverse and longitudinal beams are arranged to form an external outline which can be inscribed in a rectangle having a longitudinal length measured along a first transverse axis, X2, and a transverse width measured along a second transverse axis, X3, normal to the first transverse axis, X2. In certain embodiments, the longitudinal and transverse beams (210*x*, 210*y*) are straight and form a rectangle or even a square as shown in FIGS. 5A, 5B, 5C and 5D. The drawer frame (210) must be suitable (a) for hosting at least a ladle shroud (111) and (b) for sliding along a passage (120) of a support frame to bring the bore (115) of a ladle shroud (111) in and out of registry with the opening (114*a*) of a bottom gate plate (114*d*), by means of a hydraulic arm (40*b*) coupled to a transverse beam (210*y*) of the drawer frame (210) (cf. FIGS. 3K, 3L, 3M, 3N, 3Q, 3R, 3U and 3V. As used herein, the expression "snugly fitting" or "snugly accommodating" refers to a close fit in which motion in at least one direction is restricted.

As shown in FIGS. 1A, 1B, and 3A to 3X, the bottom floor of a ladle (11) comprises an inner nozzle (113) with a bore extending from an inlet (113*a*) at an inner end of the inner nozzle to an outlet (113*b*) at the opposite end of the inner nozzle, said bore bringing in fluid communication the interior of the ladle (11) with the exterior thereof. The outlet (113*b*) of the inner nozzle bore is coupled with a top gate plate (114*u*) comprising a planar top surface and a planar bottom surface parallel to the planar top surface and separated therefrom by the thickness of the top gate plate, as shown in FIGS. 10A and 10B. The top gate plate (114*u*) is provided with a through-opening extending through the thickness of the top gate plate from the planar top surface to the planar bottom surface, and is stationarily coupled to the outer surface of the bottom floor of a ladle (11) with the through-opening in fluid communication with the outlet orifice (113*b*) of the inner nozzle (113), By "stationarily coupled," it is meant that, in use, the top gate plate (114*u*) does not move with respect to the ladle and, in particular, with respect to the inner nozzle.

The assembly for coupling a ladle shroud (111) to a ladle (11) further comprises a support frame (211). The support frame comprises a top plate (211*u*) having a top planar surface normal to a longitudinal axis, X1, normal to both first and second transverse axes, X2, X3, and comprising an opening. The top plate (211*u*) snugly encases a bottom gate plate (114*d*) having a planar top surface slightly protruding above the top planar surface (211*u*) of the support frame (211) and a planar bottom surface, parallel to said top surface and separated therefrom by the thickness of the bottom gate plate. The bottom gate plate is provided with an opening (114*a*) extending through the thickness of the bottom gate plate, parallel to the longitudinal axis, X1. In use, the support frame is coupled to the bottom floor of a ladle (11) such that the top surface of the bottom gate plate (114*d*) is parallel to and in sliding contact with the bottom surface of the top gate plate (114*u*) and such that it can slid from a sealed position to a casting position and back by means of a hydraulic arm (40*a*). In the sealed position, the opening (114*a*) of the bottom gate (114*d*) is out of registry with the through-opening of the top gate plate (114*u*) (cf. FIGS. 3A to 3J and 3S to 3X), and in the casting position the opening (114*a*) of the bottom gate (114*d*) is in registry with the through-opening of the top gate plate (114*u*) (cf. FIGS. 3K to 3R). Casting of molten metal through the ladle shroud (111) is only possible when, (a) the ladle shroud and drawer frame (210) are in their casting position with the bore (115) of the ladle shroud (111) in registry with the opening (114*a*) of the bottom gate plate (114*d*), and (b) the support frame (211) is in its casting position with the opening (114*a*) of the bottom gate plate (114*d*) in fluid communication with the through opening of the top gate plate (114*u*) and thus with the bore of the inner nozzle (113).

For allowing the sliding of the drawer frame (210) holding a ladle shroud (111) to its casting position, the support frame (211) comprises a T-shaped passage (120) extending from a frame inlet along the first transverse axis, X2. The vertical bar of the T-passage (120) is configured for allowing passage of the tubular portion of a ladle shroud (111), whilst the horizontal bar of the T-passage (120)—which extends parallel to the second transverse axis, X3—is configured for accommodating the drawer frame (210) and sliding it along the passage on two guiding rails (117). The two guiding rails (117) extend along the first transverse axis, X2, and parallel to said top planar surface of the top plate (211*u*), on each protruding end of the horizontal bar of the T-passage, on either side of the vertical bar of the T-passage. The guiding rails are separated from one another by a gap having a width measured along the second transverse axis, X3, which is superior to the diameter, Dt, of the tubular portion of the ladle shroud and slightly inferior to the transverse width of the rectangle in which the drawer frame (210) is inscribed. In order to allow the insertion from the bottom into the drawer frame (210) of a collector nozzle, the gap should have a width, at least locally greater than the width of the ladle shroud plate and thus of the cavity defined by the drawer frame (210). In other words, the guiding rails (117) should be configured for supporting in a sliding relationship the longitudinal beams (210*x*) of the drawer frame (210), without extending, at least locally over the cavity thereof.

Finally, the support frame (211) must comprise two sets of pushers (118) or rockers positioned adjacent to the two bottom guiding rails (118) on either side of the gap, at the level of the bottom gate plate opening. Pushers (118) or rockers are well known in the art with respect to pouring nozzles used in tube exchange devices coupled to the bottom floor of a tundish (10) such as disclosed e.g., in WO2011/113597. Pushers are used for pressing the upstream surface (2*u*) of a ladle shroud (111) in tight and sealed contact against the lower surface of a bottom gate plate (114*d*), when the drawing frame (210) and thus the ladle shroud (111) are in their casting position with the ladle shroud bore (115) in registry with the opening (114*a*) of the bottom gate plate (114*d*). When the ladle shroud (111) is not in casting position, the coupling assembly must support the ladle shroud own weight only, and the latter can therefore hang on the latches only. When the drawer frame is slid together with the ladle shroud into their casting position, the ladle shroud rests on the pushers (118) or rockers. This is necessary because the pushers ensure, on the one hand, a sealed contact between the ladle shroud and the bottom gate plate and, on the other hand, a strong coupling to the ladle (11) able to resist the pressure of flowing metal through the ladle shroud and, in particular, any hammer possible in particular at the beginning of the casting operation or in case of loosened solid lumps which may have temporarily clogged the bore.

The resilient latches (30) can be mounted on the drawer frame (210) as illustrated in FIGS. 3A to 7, and 10A. Alternatively they can be mounted on the support frame (211) as illustrated in FIGS. 8 and 10B. All that is required is that when the drawer frame (210) is inserted in the passage (120) of the support frame (211), said first and second latches can be located above or below the top sliding surface of the two guiding rails, vis-à-vis one another on either side of the gap formed between the guiding rails. The terms "above" and "below" refer herein to the position with respect to the sliding surfaces when the support frame and drawer are coupled to a ladle ready for casting. In case the latches are mounted on the support frame (211) (cf. FIGS. 8 & 10B), the latches should be offset in the first transverse direction, X2, with respect to the opening (114*a*) of the bottom gate plate (114*d*) and thus of the pushers (118) or rockers, to allow enough clearance for the insertion between the two latches of a ladle shroud from the bottom. If the latches (30) are mounted on the drawer frame (210), they will follow the translating movements of the ladle shroud (111) between its hanging and casting positions as the hydraulic arm (40*b*) moves the drawer frame back and forth. This means that, unlike in the case wherein the latches are mounted on the support frame (211), the ladle shroud (111) remains in contact with the latches also in its casting position. This is not a problem, since the latches are designed to prevent the ladle shroud from falling down under its own weight, and the pushers apply an upward force onto the downstream surface (4*d*) of the ladle shroud plate, pressing the upper surface (2*u*) against the bottom gate plate (114*d*). These two operations are quite compatible with one another and the latches thus do not interfere with the pushers.

As shown in FIG. 9, each of the two resilient latches (30) comprises a chamfered upstream surface (30*u*) forming an angle, β1, with a plane parallel to the first and second transverse axes, X2-X3, substantially equal to the angle, β1, formed by the trailing edge (3*d*) of the upstream protrusion (3) of a ladle shroud (111) according to the present invention, so that the ladle shroud (111) can rest on a matching surface of the latches. Each of the two resilient latches (30) also comprises a chamfered downstream surface (30*d*) forming an angle, α1, with a plane parallel to the first and second transverse axes, X2-X3, substantially equal to the angle, α1, formed by the leading edge (3*u*) of the upstream protrusion (3) of a ladle shroud (111).

In case the ladle shroud (111) comprises a downstream protrusion (4) as illustrated in FIG. 2C, the leading edge (4*u*) of said downstream protrusion should form the same angle, α1, as the downstream surface (30*d*) of the latches so that the two surfaces are in matching contact as illustrated in FIGS. 10A and 10B. In this configuration, the ladle shroud geometry defined by the recess formed between the upstream and downstream protrusions (3, 4) should match the geometry of the latches (30) defined by the upstream and downstream surfaces (30*u*, 30*d*) and the surface separating them. This allows a stable and reproducible gripping of a ladle shroud between the latches.

As can be seen in FIG. 9, the latches (30) are movable back and forth along the second transverse axis, X3, from a coupling position to a loading position. In the coupling position, the first and second latches are closest to one another, separated by a distance, d, as illustrated in the top set of latches of FIG. 9, with the upstream and downstream chamfered surfaces of the first and second latches protruding out in the gap between the two guiding rails. If a ladle shroud (111) is inserted between the two latches (30) in their coupling position, the trailing edge (3*d*) of the ladle shroud upstream protrusions (3) can rest on the matching upstream surfaces (30*u*) of the latches, and the ladle shroud cannot fall down under its own weight. In the loading position, the first and second latches are furthest apart, separated by a distance of about d+2 Hd, wherein Hd is the height of a trailing edge (3*d*) of a ladle shroud upstream protrusion (3). In this loading position the first and second latches do not protrude in the gap between the two guiding rails and a ladle shroud can be inserted from below between the two latches when they are in their loading position.

In order to provide a snap-fit effect upon introducing a ladle shroud (111) from below between two latches, they are mounted on resilient latch drivers (31) naturally biased to drive the latches to their coupling position (cf. FIGS. 4A, 4B, 4C, 4D and 9). This way, as a ladle shroud (111) is introduced from below a drawer frame (210) inserted in a support frame (211) (cf. FIGS. 3C and 3D), the leading edges (3*u*) of the upstream protrusions (3) of the ladle shroud, which form an angle, α1, contact the downstream surfaces (30*d*) of the latches (30) which form the same angle, α1 (cf. FIGS. 3E and 3F). By pressing upwards the ladles shrouds against the downstream surfaces (30*d*) of the latches, the latches (30) will recede as the ladle shroud is pushed up, by sliding along the leading edges (3*u*), until the latches are pushed back to the level of the upstream ridges (3*r*) of the upstream protrusions (3) where they reach their loading position (cf. FIGS. 3G, 3H and 9 (bottom)). By pushing the ladle shroud further up, the upstream ridges (3*r*) are brought passed the latches, which spring back to their coupling position, driven by the resilient latch drivers (cf. FIGS. 3I, 3J & 10). At this stage, the trailing edges (3*d*), forming an angle, β1, contact the matching upstream surfaces (30*u*) of the latches (30) which form the same angle, β1, and the ladle shroud (111) is thus coupled to the ladle (11) and capable of remaining thus coupled without any external tool or robot (20).

One great advantage of the latches (30) in the present invention is that the coupling of the ladle shroud to the ladle is reversible and that a ladle shroud (111) can easily be un-coupled from the ladle (11) by simply pulling downwards the ladle shroud, e.g., with a robot (20), with sufficient force for the latches to recede as the upstream surfaces (30*u*) of the latches slide along the trailing edge (3*d*) of the upstream protrusion (3), until they reach the level of the upstream ridge (3*r*) where the latches are at their loading position. Pulling the ladle shroud further down will disengage it from the latches which return to their coupling position, driven by the resilient latch drivers (31). The angles, α1&β1, and the stiffness of the resilient latch drivers (31) must be such that (a) it is easy to insert a ladle shroud between two latches by pushing it up with a reasonable force, (b) the ladle shroud is supported by the latches which can hold the ladle shroud own weight, and (c) it is easy to disengage the ladle shroud by pulling it down with a reasonable force. For this reason, in certain embodiments, the leading edge (3*u*) of the upstream protrusion (3) is slanted by an angle, α1, which is greater than the angle, β1, formed by the trailing edge (3*d*) of the upstream protrusion (3). This way, it is easier to move the resilient latches to their loading position when inserting a ladle shroud than when disengaging it from the latches, since the sliding angle, α1, between the leading edge (3*u*) and the downstream surface (30*d*) of the latches (30) is larger than the sliding angle, β1, between the trailing edge (3*d*) and the upstream surface (30*u*) of the latches (30) (i.e., sliding angle, β1, is more horizontal). This is important since when inserting a ladle shroud, the robot must apply a force sufficient to carry the ladle shroud own weight and to push the latches to their loading position, whilst when disengaging a ladle shroud, the ladle shroud own weight actually helps pushing the latches back to their loading position.

The resilient latch drivers (31) can be any resilient devices known in the art. In particular, in a first embodiment illustrated in FIGS. 3A to 3X, 4A and 4B, 5A to 5D, and 8 to 10B, the resilient latch drivers (31) comprise a coil spring, in some embodiments enclosing a telescopic axle (32) visible in FIG. 9, said coil spring being coupled to a latch and sandwiched between the latch (30) and a catch fixed at constant distance along the second transverse axis, X3, from the corresponding guiding rails (117). In a second embodiment illustrated in FIGS. 4C, 4D, 6A, 6B, 6C, 6D and 7, the resilient latch drivers (31) comprise a cantilever spring consisting of an elastically flexible leaf pushing at one end thereof to the latch (30) and at the opposite end either to the corresponding longitudinal beam (210*x*) of the drawer frame (210) or below the top sliding surface of the two bottom guiding rails (117) of the support frame (211).

The drawer frame (210) illustrated in FIGS. 5A to 5D defines a cavity configured for hosting a single ladle shroud (111) which can be inserted between two latches (30) resiliently mounted on the longitudinal beams (210*x*) and provided with coil springs (31) as discussed supra with respect to the first embodiment. It can be seen that the latches may be engaged in an aperture on each longitudinal beam (210*x*) which face each other. By means of a telescopic axle (32) and coil spring (31) the latches (30) can reversibly and resiliently move through said aperture along the second transverse direction, X3 between their coupling and loading positions and back.

Figure 4A:
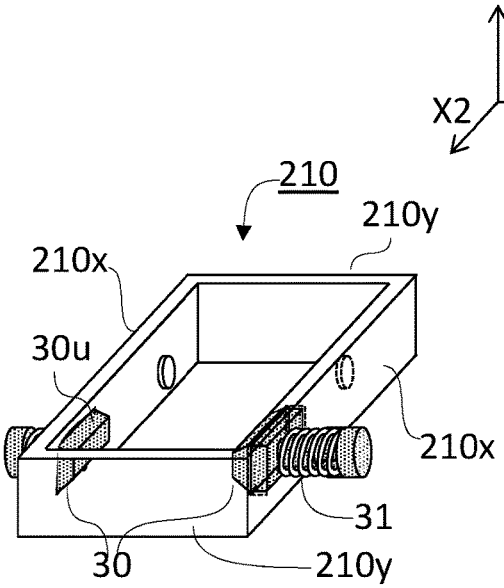
FIG. 4A shows an embodiment of a drawer frame provided with latches mounted on coil spring resilient latch drivers in coupling position.
Figure 4C:
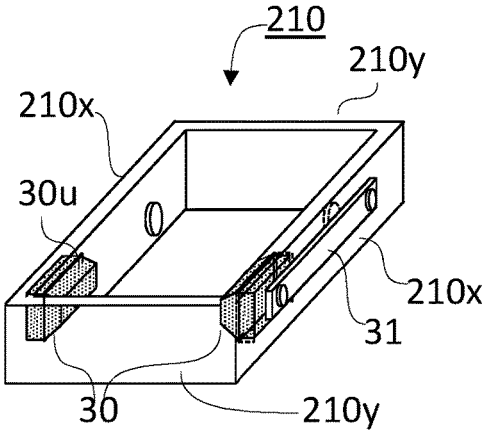
FIG. 4C shows an embodiment of a drawer frame provided with latches mounted on cantilever spring resilient latch drivers in coupling position.
Figure 4B:
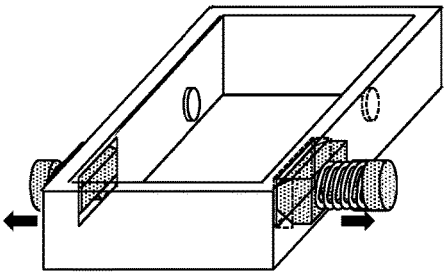
FIG. 4B shows an embodiment of a drawer frame provided with latches mounted on coil spring resilient latch drivers in coupling position.
Figure 4D:
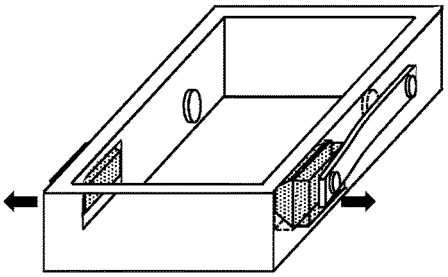
FIG. 4D shows an embodiment of a drawer frame provided with latches mounted on cantilever spring resilient latch drivers in coupling position.
Figure 5D:
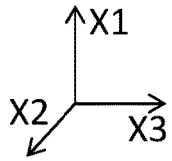
FIG. 5D shows a first embodiment of a drawer frame.
Figure 5D:
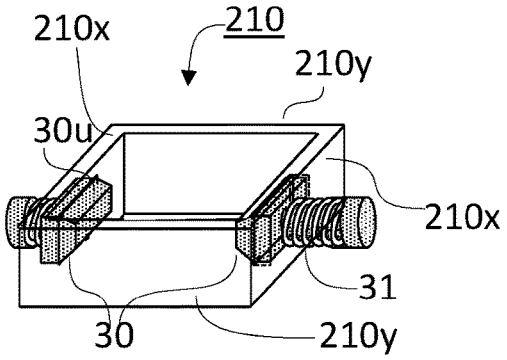
Figure 5B:
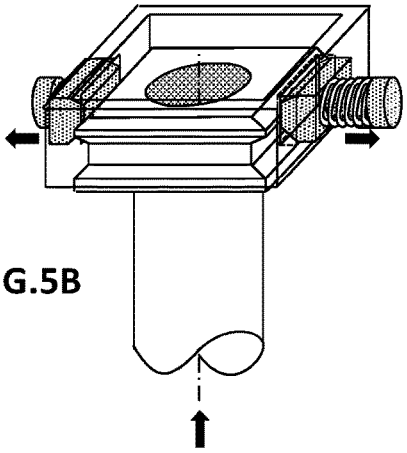
FIG. 5B shows a step in a loading sequence of a ladle shroud into a first embodiment of a drawer frame.
Figure 5A:
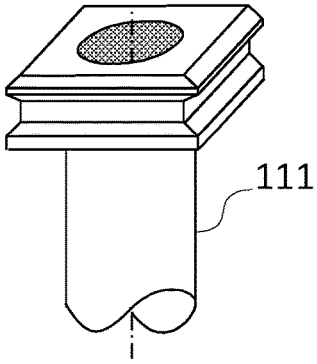
FIG. 5A shows a ladle shroud.
Figure 5C:
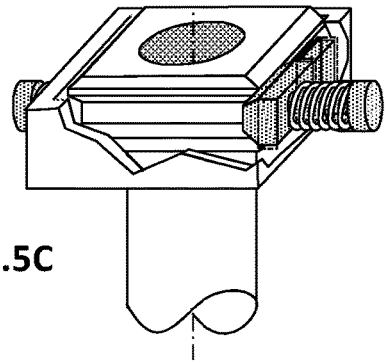
FIG. 5C shows a step in a loading sequence of a ladle shroud into a first embodiment of a drawer frame.
Figure 6A:
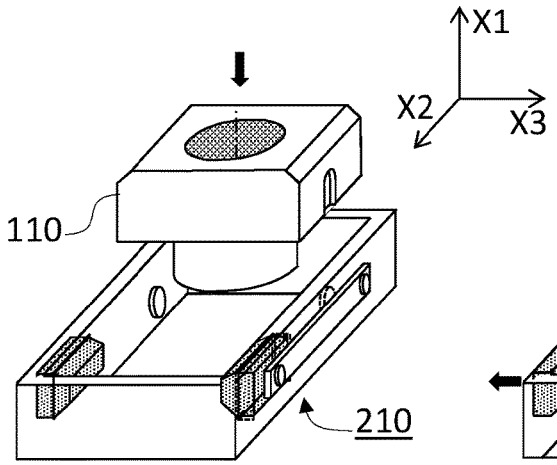
FIG. 6A shows a step of a loading sequence of a collector nozzle and of a ladle shroud into a second embodiment of drawer frame.
Figure 6C:
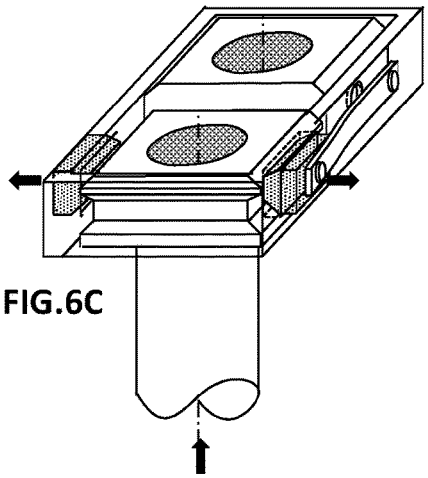
FIG. 6C shows a step of a loading sequence of a collector nozzle and of a ladle shroud into a second embodiment of drawer frame.
Figure 6B:
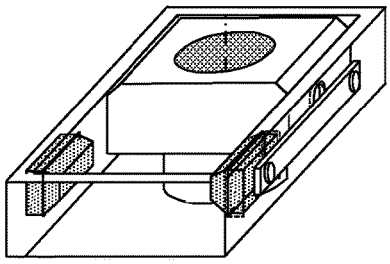
FIG. 6B shows a step of a loading sequence of a collector nozzle and of a ladle shroud into a second embodiment of drawer frame.
Figure 6D:
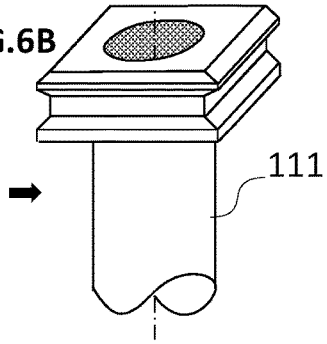
FIG. 6D shows a step of a loading sequence of a collector nozzle and of a ladle shroud into a second embodiment of drawer frame.
Figure 6D:
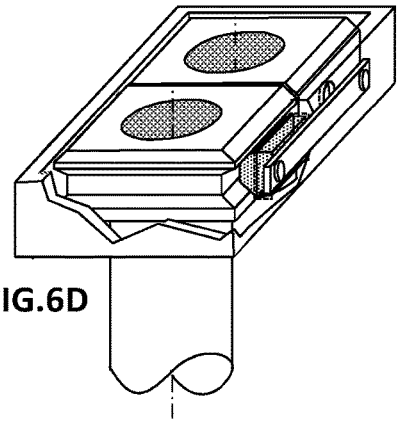

FIGS. 4A to 4D show two embodiments of drawer frames (210) which have in common that the cavity can host two ladle shroud plates positioned side by side along the first transverse direction, X2. This geometry allows engaging in the drawer frame a ladle shroud (111) and a collector nozzle (110). A collector nozzle (110) comprises an inlet portion comprising a plate with a planar upstream surface, and a tubular portion which is very short. A bore extends from the upstream surface to the end of the short tubular portion. The use of such collector nozzle (110) is explained below with respect to FIGS. 3A to 3X. The same resilient latch drivers according to the first embodiment and as discussed with respect to FIGS. 5A to 5D are represented in FIGS. 4A and 4B. FIGS. 4C and 4D show a second, alternative embodiment of an elastically flexible leaf fixed in cantilever at one end thereof to the longitudinal beam (210*x*) of the drawer frame (210) and at the opposite end to the latch (30). Again, the latch can resiliently move back and forth along the second transverse axis, X3, through apertures located in the longitudinal beams (210*x*). FIGS. 4A and 4C show the latches in their coupling position, and FIGS. 4B and 4D in their loading position.

FIG. 8 shows a drawer frame (210) devoid of any latches (30), the latches being mounted on the support frame (211) below the top sliding surface of the two bottom guiding rails (117). In this case the drawer frame (210) is of very simple construction. This is particularly true for a drawer frame (210) designed for hosting a single ladle shroud and no collector nozzle (this is not the case in FIG. 8). Regardless of whether for one or two nozzles, such drawer frame is nonetheless useful because a hydraulic arm (40*b*) can be coupled to one of the transverse beams (210*y*) for sliding the drawer frame in and out of its casting position (cf. FIGS. 3A to 3D). It is not so easy to couple the hydraulic arm (40*b*) directly to a ladle shroud.

Figure 7:
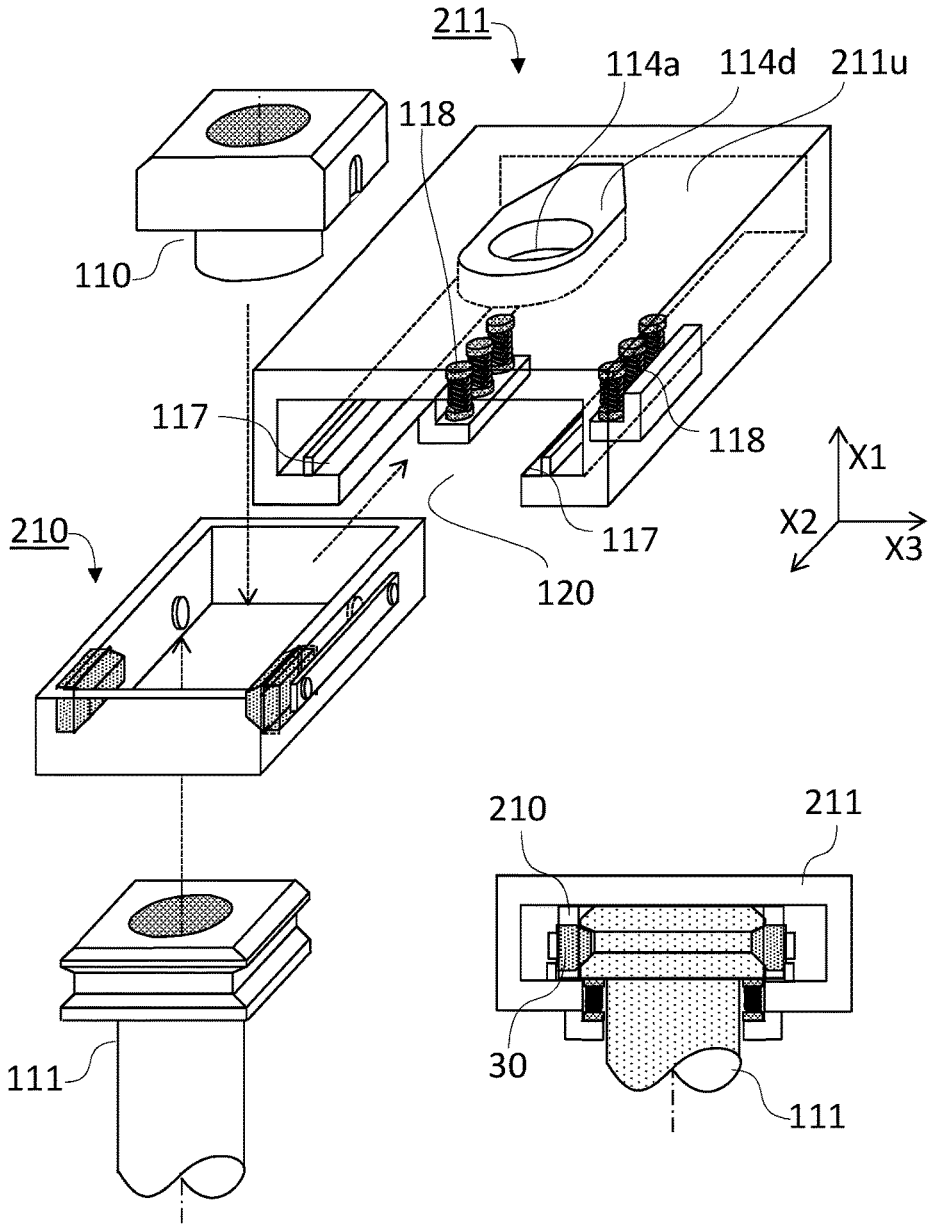
FIG. 7: shows a loading sequence of a drawer frame according to FIGS. 6A to 6D into a support frame, and loading of a collector nozzle and ladle shroud into said drawer frame.
Figure 8:
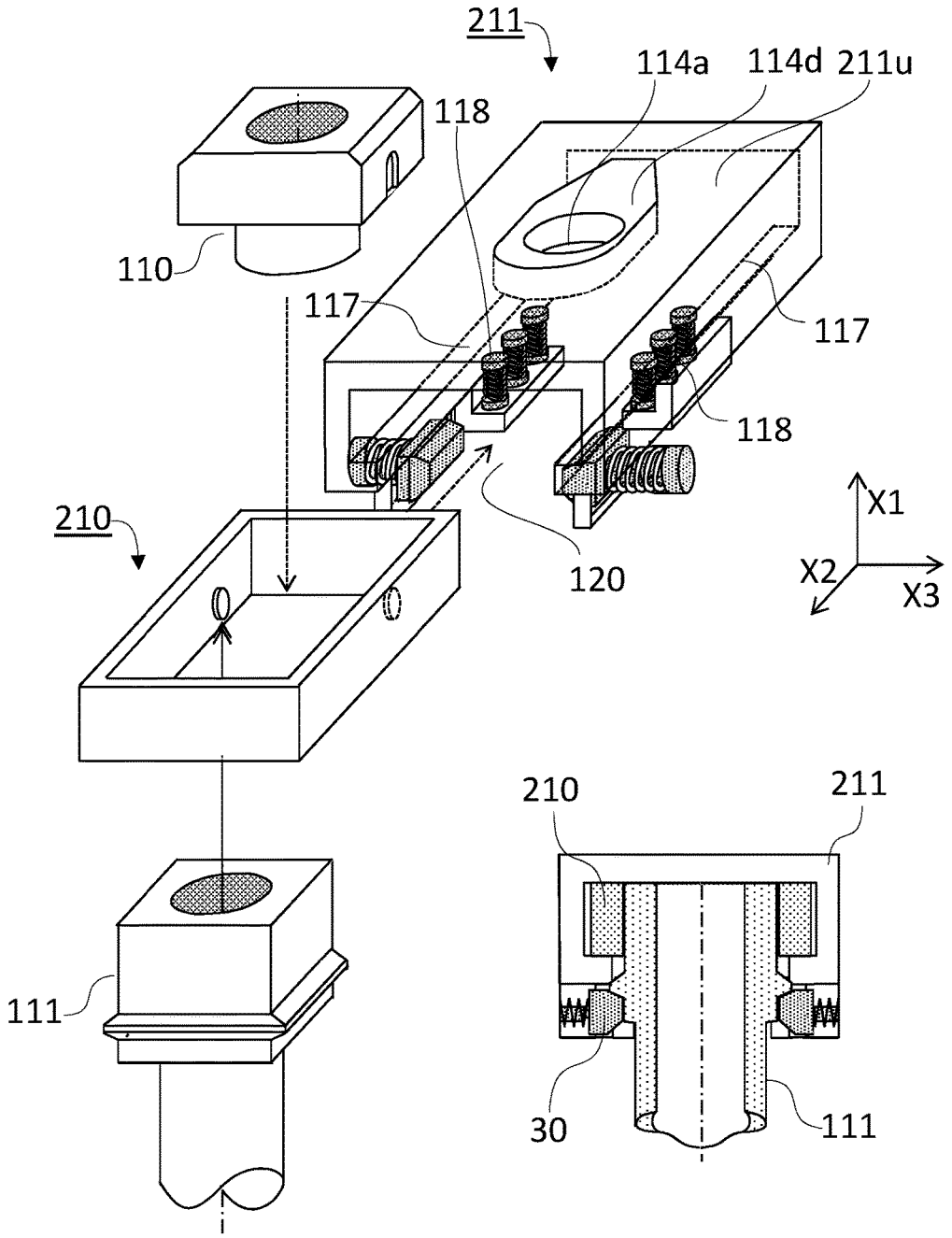
FIG. 8: shows a loading sequence of a drawer frame into a support frame equipped with resilient latches, and loading of a collector nozzle and ladle shroud into said drawer frame.

FIGS. 5A to 8 show the interactions with one another of a ladle shroud (111), optionally a collector nozzle (110), a drawer frame (210) and a support frame (211) which is slidingly coupled to a ladle as explained supra. The drawer frame (210) is engaged into the T-passage (120) of the support frame with the longitudinal beams (210*x*) of the drawer frame (210) resting on the guiding rails (117). By connecting a hydraulic arm (40*b*) to a transverse beam (210*y*) of the drawer frame (210), the latter can be moved in and out of its casting position by sliding along the guiding rails (117). In case of a drawer frame capable of hosting both a ladle shroud (111) and a collector nozzle (110) as illustrated in FIGS. 7&8, it can be loaded in the drawer frame (210) before or after engaging the drawer frame (210) into the T-passage (120). Once the drawer frame (210) is engaged in the T-passage it is moved to a receiving position, wherein a ladle shroud (111) can be loaded up from the bottom into its corresponding position in the cavity defined by the drawer frame (210) and hung between the resilient latches (30). If the drawer frame hosts a collector nozzle (110) too, as illustrated in FIGS. 7&8, when the drawer frame (210) is in its receiving position, the collector nozzle (110) may rest on the pushers (118) or rockers. This configuration illustrated in FIGS. 3E and 3F permits to reduce the size of the support frame (211).

In its receiving position in the T-passage, the drawer frame (210) is ready for receiving a ladle shroud (111) in the cavity as explained supra, by pushing it up with a robot (20) or other handling tool, through the resilient latches (30) until the trailing edges (3*d*) of the upstream protrusions (3) rest on the upstream surfaces (30*u*) of the latches, and the ladle shroud safely hangs below the ladle (10) in an idle position. By actuating the hydraulic arm (40*b*) the drawer frame (210) together with the ladle shroud (111) engaged in the cavity thereof, can be moved to their casting position wherein the bore (115) of the ladle shroud is in registry with the opening (114*a*) of the bottom gate plate (114*d*). In this position, the pushers (118) press on the downstream surface (4*d*) of the ladle shroud plate such as to form a sealing contact between the upstream surface (2*u*) of the ladle shroud and the lower surface of the bottom gate plate (114*d*). If the drawer frame (210) hosts a collector nozzle (110), the latter is moved to an idle position as shown in FIGS. 3K and 3L. FIGS. 7&8 only differ from one another in the position of the resilient latches (30): in FIG. 7 they are engaged in openings provided in the longitudinal walls (210*x*) of the drawer frame (210), and in FIG. 8 they are mounted on the support frame, below the guiding rails (117) and beside the pushers (118) in the longitudinal direction, X1. Similarly, FIG. 10A shows an embodiment with latches mounted on the drawer frame (210) and FIG. 10B shows an embodiment with latches mounted on the support frame.

FIGS. 3A to 3X illustrate a number of process steps possible with a coupling assembly according to the present invention. For each step referred to by a pair of consecutive letters following the "FIG. 3" designation, two cut views are showed along two orthogonal planes (X1, X3) and (X1, X2).

FIGS. 3A and 3B show the bottom floor of a ladle (11) comprising an inner nozzle (113) in contact with a top gate plate (114*u*) such that the bore (113*a*, 113*b*) of the inner nozzle is in fluid communication with the through opening of the top gate plate. As discussed above, the position of the top gate plate (114*u*) remains fixed with respect to the ladle bottom floor throughout the casting operations. A support frame is coupled to the ladle (11) such that the opening (114*a*) of the bottom gate (114*d*) is out of registry with the through opening of the top gate plate (114*u*). The support frame (211) with bottom gate plate (114*d*) can slide by means of a hydraulic arm (40*a*) such as to bring the opening (114*a*) of the bottom gate plate (114*d*) in and out of registry with the through opening of the top gate plate (114*u*). A drawer frame (210) loaded with a collector nozzle (110) is shown separate from the support frame (211). The collector nozzle (110) can be loaded on the drawer frame (210) before or after the latter is engaged in the T-passage of the support frame (211).

In FIGS. 3C and 3D, the drawer frame (210) is inserted into the T-passage (120). A transverse beam (210*y*) is coupled to a hydraulic arm (40*b*). The hydraulic arm (40*b*) moves the drawer frame (210) to its receiving position, ready to receive a ladle shroud (111) and with the collector nozzle (110) resting on the pushers (118) with the bore thereof in registry with the opening (114*a*) of the bottom gate (114*d*). A ladle shroud (111) is brought below the support frame and drawer frame with a robot (20) or any other handling tool.

In FIGS. 3E to 3J the ladle shroud (111) is pushed up between the latches (30) into its position in the cavity defined by the drawer frame (210) until the trailing edges (3*d*) of the upstream protrusions (3) rest on the upstream surfaces (30*u*) of the latches (30). At this stage, neither the support frame (211) nor the drawer frame (210) have been moved by the respective hydraulic arms (40*a*, 40*b*) with respect to their respective positions in FIGS. 3C and 3D.

FIGS. 3I and 3J show a particular technique discussed in the introductory section above and traditionally used to prevent stagnant metal melt from freezing in the bore of the inner nozzle (113) prior to initiating casting. Before filling a ladle with molten metal (200), the bore of the inner nozzle (113) is filled with a plugging material (300), usually sand. Upon filling the ladle, some molten metal percolates a short distance through the sand bed (300) and freezes forming a solid cap (301) made of a mixture of sand particles and solid metal, thus preventing molten metal (200) from flowing through the bore inlet (113*a*).

As illustrated in FIGS. 3K and 3L, upon sliding, on the one hand, the drawer frame (210) with the hydraulic arm (40*b*) to its casting position, with the bore (115) thereof in registry with the opening (114*a*) of the bottom gate plate (114*d*) and, on the other hand, the support frame (211) with the hydraulic arm (40*a*) to its casting position, wherein the top and bottom gate plates (114*u*, 114*d*) and their respective openings are aligned, the plugging material flows out of the inner nozzle bore, through the gate (114*u*, 114*d*) and out of the ladle shroud (111) into the bottom of a tundish (10). Most of the times the weight of the molten metal pressing upon the cap (301) is sufficient to break the crust (301) and casting of molten metal through the ladle shroud (111) into a tundish can thus start. In some cases, however, illustrated in FIGS. 3M and 3N, the crust forming the cap (301) is sufficiently thick to resist the pressure of the molten metal and seals the bore inlet (113*a*) of the inner nozzle so that the casting process cannot start. It is therefore necessary to break such cap with a tool. Generally a torch (21) is inserted from below into the bore of a collector nozzle (110) and used to melt the crust of the cap (301).

In traditional installations the collector nozzle is nested in the conically tapering bore of the ladle shroud as shown in FIG. 1B. Because of the length of the tubular portion of the ladle shroud, this must first be removed from the collector nozzle before a torch (21) can be inserted to melt the crust (301) to initiate flow of molten metal through the collector nozzle. At this stage the ladle shroud must rapidly be re-inserted over the collector nozzle to shield the flowing metal from oxygen. This operation is very cumbersome and dangerous as spilling of molten metal is inevitable upon re-insertion of the ladle shroud during flow of molten metal.

With the coupling assembly of the present invention, the ladle shroud (111) and collector nozzle (110) are aligned side by side in the drawer frame (210). In case of clogging of the inner nozzle, the collector nozzle (110) can be brought to casting position by sliding the drawer frame (210) with the hydraulic arm (40*b*) (cf. FIGS. 3M and 3N). This operation brings the ladle shroud (111) to its idle position, such that it is held by the latches (30) only (cf. FIGS. 3N and 3P). Access to the bore of the inner nozzle is very easy through the collector nozzle (110). When the crust (301) is melted, molten metal can flow through the inner nozzle (113), gate (114*u*, 114*d*) and collector nozzle (110). At this stage, as illustrated in FIGS. 3Q and 3R, the hydraulic arm (40*b*) can be activated to slide the drawer frame (210) to bring the ladle shroud (111) back to its casting position. Casting of molten metal into a tundish can thus be started easily, rapidly, and with no spilling of molten metal as the ladle shroud (111) is brought to its casting position. The danger of such operation has thus been substantially reduced compared with traditional metallurgic installations.

As shown in FIGS. 3S and 3T, when the ladle is empty (or it has been decided to stop the casting operation from the ladle), the hydraulic arm (40*a*) is actuated to slide the support frame (211) to seal the gate by bringing the opening (114*a*) of the bottom gate plate (114*d*) out of registry with the through-hole of the top gate plate (114*u*). As shown in FIGS. 3U and 3V, the ladle shroud (111) is then brought to its idle position, off the pushers (118), by sliding the drawer frame (210) with the hydraulic arm (40*b*), such that the ladle shroud (111) hangs on the latches (30) only. FIGS. 3W and 3X show how a robot (20) can grab the ladle shroud (111) and force its passage down through the resilient latches (30) and thus be removed from the ladle (11).

The coupling assembly of the present invention comprising a support frame (211), a drawer frame (210), and a ladle shroud (111) as defined above allows a very clean and reproducible casting operation from a ladle (11). This assembly is also advantageous in that many operations can be automated and controlled by a central processing unit (CPU), thus further increasing the security level of such operations.

Numerous modifications and variations of the present invention are possible. It is, therefore, to be understood that within the scope of the following claims, the invention may be practiced otherwise than as specifically described.

LIST OF REFERENCE NUMERALS

2*p* upstream perimeter
2*u* planar upstream surface of ladle shroud
3*d* trailing edge of UP (3)
3*r* upstream ridge of UP (3)
3*u* leading edge of UP (3)
3 upstream protrusion (UP)
4*d* downstream surface
4*p* downstream perimeter
4*r* downstream ridge
4*u* leading edge of DP (4)
4 downstream protrusion (DP)
10 tundish
11 ladle
20 robot or handling tool
21 torch
30*d* downstream chamfered surface
30*u* upstream chamfered surface
30 first and second latches
31 resilient means of latches, or resilient latch drivers
32 telescopic axle
40*a* hydraulic arm for support frame (211)
40*b* hydraulic arm for drawer frame (210)
100 mould
101 pouring nozzle
110 collector nozzle
111 ladle shroud
113 Inner nozzle
113*a* Inlet orifice of inner nozzle (113)
113*b* outlet orifice of inner nozzle (113)
114*a* opening of the bottom gate plate 114*d*
114*d* bottom gate plate
114*u* top gate plate
115*a* inlet orifice
115*b* outlet orifice
115 bore
117 bottom guiding rails
118 pushers
120 T-shaped passage
200 Molten metal
210*x* longitudinal beams of DF (210)
210*y* transverse beams of DF (210)
210 drawer frame (DF)
211*u* top plate of support frame (211)
211 support frame
300 Plugging material
301 Crust of sintered material
$\alpha$1 angle of leading edge 3*u*
$\alpha$2 angle of leading edge 4*u*
$\beta$1 angle of trailing edge 3*d*
Hd height of trailing edge 3*d*
Hu height of leading edge 3*u*

What is claimed is:

1. Ladle shroud for casting metal from a ladle, said ladle shroud comprising:

(a) a bore extending parallel to a first longitudinal axis, X1, from an inlet orifice to an outlet orifice, (b) an inlet portion located at an upstream end of the ladle shroud and consisting of a plate comprising:

a planar upstream surface normal to said first longitudinal axis, X1, said upstream surface comprising said inlet orifice and being defined by an upstream perimeter, a downstream surface defined by a downstream perimeter and separated from the upstream surface by, a peripheral wall contiguous to both upstream and downstream perimeters defining the thickness of the plate at the level of the upstream perimeter, and comprising at least a first and a second gripping portions separated from each other by the bore, (c) a tubular portion extending along said first longitudinal axis, X1, from said downstream surface of the inlet portion to a downstream end, opposite to an upstream end, and where said outlet orifice is located, wherein, each of said first and second gripping portions of the peripheral wall comprises an upstream protrusion culminating at an upstream ridge separating a leading edge facing towards the upstream end of the ladle shroud from a trailing edge facing towards the downstream end of the ladle shroud, and protruding out beyond the whole peripheral wall of the corresponding gripping portion, said upstream protrusions extending parallel to the upstream surface and substantially symmetrically to one another with respect to the first longitudinal axis, X1, along the respective first and second gripping portions and wherein, said leading edge forms with a plane parallel to the upstream surface an angle, $\alpha$1, and said trailing edge (3*d*) forms an angle, $\beta$1, with a plane parallel to the upstream surface (2*u*), wherein all $|\alpha 1| \geq |\beta 1|$.

2. Ladle shroud according to claim 1, wherein said peripheral wall comprises a third and a fourth gripping portions separated from each other by the bore, said third and fourth gripping portions having same geometry and dimensions as, and extending contiguously transverse to the first and second gripping portions, and comprising an upstream protrusion (3) of same geometry as the one of the first and second gripping portions.

3. Ladle shroud according to claim 1, wherein $\alpha$1 has a value from and including 45° to and including 70°, and wherein $\beta$1 has a value from and including 25° to and including 45°.

4. Ladle shroud according to claim 1, wherein in each of the first and second gripping portions:

the distance, Hu, from the upstream ridge of the upstream protrusion to the bottom of the leading edge measured along a plane parallel to the upstream surface is greater than 5 mm, and the distance, Hd, from the upstream ridge of the upstream protrusion to the bottom of the trailing edge measured along a plane parallel to the upstream surface is equal or different from Hu, and is greater than 5 mm.

5. Ladle shroud according to claim 1, wherein each of the first and second gripping portions further comprises a downstream protrusion culminating at a downstream ridge separating a leading edge facing towards the upstream protrusion from the downstream surface, and extending parallel to the upstream protrusion along the respective first and second gripping portions, the upstream ridge and downstream ridge being separated from one another by a recess.

6. Ladle shroud according to claim 1, wherein the portions of the upstream perimeter and downstream perimeter corresponding to each of the first and second gripping portions are straight lines.

7. Kit of parts for fluidly coupling a ladle shroud according to claim 1 to the outlet orifice of an inner nozzle of a ladle, at an outer surface of a bottom floor of said ladle, said kit of parts comprising:

(a) a drawer frame comprising two longitudinal beams extending along a first transverse axis, X2, separated from one another by two transverse beams, thus defining a cavity of area and perimeter suitable for snugly accommodating the equivalent of at least one upstream surface of a ladle shroud according to claim 1, the transverse and longitudinal beams being so arranged as to form an external outline which can be inscribed in a rectangle having a longitudinal length measured along a first transverse axis, X2, and a transverse width measured along a second transverse axis, X3, normal to the first transverse axis, X2, (b) a top gate plate, comprising a planar top surface and a planar bottom surface parallel to the planar top surface and separated therefrom by the thickness of the top gate plate, and being provided with a through-opening extending through the thickness of the top gate plate from the planar top surface to the planar bottom surface, said top gate plate being configured to be stationarily coupled to the outer surface of the bottom floor of the ladle with the through-opening in fluid communication with the outlet orifice of the inner nozzle, (c) a support frame configured to be coupled to the outer surface of the bottom floor of the ladle such that it can be slid from a sealed position to a casting position and back, said support frame comprising:

a top plate having a top planar surface normal to a longitudinal axis, X1, normal to both first and second transverse axes, X2, X3, and comprising an opening in which is snugly encased:

a bottom gate plate having a top surface slightly protruding above the top planar surface of the support frame and a bottom surface, parallel to said top surface and separated therefrom by the thickness of the bottom gate plate, said bottom gate plate being provided with an opening extending through the thickness of the bottom gate plate, parallel to the longitudinal axis, X1, and wherein when the support frame is coupled to the ladle, the top surface of the bottom gate plate is parallel to and in sliding contact with the bottom surface of the top gate plate, such that upon sliding the support frame from its sealed position to its casting position, the opening of the bottom gate plate is moved from a position wherein it is sealed from the through-opening of the top gate plate to a position where it is in fluid communication with the through opening of the top gate plate, two guiding rails extending along said first transverse axis, X2, and parallel to said top planar surface of the top plate, and separated from one another by a gap having a width measured along said second transverse axis, X3, which is smaller than the transverse width of the rectangle in which the external outline of the drawer frame is inscribed, and which is at least locally larger than the width measured along the second transverse axis, X3, of the cavity defined in the drawer frame;

a T-shaped passage extending from a frame inlet along the first transverse axis, X2, said passage being configured to accommodate the drawer frame and sliding it along the passage on the two guiding rails, two sets of pushers or rockers positioned adjacent to the two guiding rails on either side of the gap, at the level of the bottom gate plate opening, wherein the kit of parts further comprises a first latch and a second latch wherein, when the drawer frame is inserted in the passage of the support frame, said first and second latches, are facing one another on either side of the gap formed between the guiding rails, have a chamfered upstream surface forming an angle, β1, with a plane parallel to the first and second transverse axes, X2-X3, substantially equal to the angle, β1, formed by the trailing edge of the upstream protrusion of a ladle shroud according to claim 1, have a chamfered downstream surface forming an angle, al, with a plane parallel to the first and second transverse axes, X2-X3, substantially equal to the angle, α1, formed by the leading edge of the upstream protrusion of a ladle shroud according to claim 1, and are movable back and forth along said second transverse axis, X3, from a coupling position, wherein the first and second latches are closest to one another and the upstream and downstream chamfered surfaces of the first and second latches protrude out in the gap between the two guiding rails, to a loading position, wherein the first and second latches are furthest apart and do not protrude in the gap between the two guiding rails, and are mounted on resilient latch drivers naturally biased to drive the latches in their coupling position.

8. Kit of parts according to claim 7, wherein the two longitudinal beams of the drawer frame each comprise an aperture facing each other through which the first and second latches can move along the second transverse axis, X3, from their coupling position to their loading position and back.

9. Kit of parts according to claim 7, wherein the first and second latches are mounted on the support frame, below the two guiding rails and offset with respect to the pushers or rockers in the first transverse direction, X2.

10. Kit of parts according to claim 7, wherein each resilient latch driver comprises a structure selected from the group consisting of:

(a) a cantilever spring consisting of an elastically flexible leaf fixed at one end thereof to the latch and at the opposite end either to the corresponding longitudinal beam of the drawer frame or below a top sliding surface of the two guiding rails of the support frame, (b) a coil spring, said coil spring being coupled to a latch and sandwiched between the latch and a catch fixed at constant distance along the second transverse axis, X3, from the corresponding guiding rails, and (c) a coil spring, enclosing a telescopic axle, said coil spring being coupled to a latch and sandwiched between the latch and a catch fixed at constant distance along the second transverse axis, X3, from the corresponding guiding rails.

11. Kit of parts according to claim 7, wherein the area and perimeter of the cavity defined by the two longitudinal beams and two transverse beams is suitable for snugly accommodating the equivalent of two upstream surfaces of ladle shrouds, positioned side by side along said first transverse axis, X2.

12. Kit of parts according to claim 11 further comprising a ladle shroud and a collector nozzle, said collector nozzle having a planar upstream surface comprising an inlet orifice and being defined by an upstream perimeter, such that the upstream perimeter of the ladle shroud and the upstream perimeter of the collector nozzle snugly fit in the cavity of the drawer frame when the ladle shroud and collector nozzle are aligned side by side along the first transverse axis, X2.

13. A metal casting installation comprising a ladle comprising a bottom floor with an inner nozzle provided with an outlet orifice;

assembled elements of a kit of parts according to claim 7, a ladle shroud; and a handling tool configured to hold said ladle shroud, bringing it below the support frame at the level of the latches, and forcing the inlet portion thereof up through the latches by deforming the resilient latch driver until the latches engage below the upstream protrusions of the ladle shroud which thus reaches its coupled position, wherein the trailing edges of the upstream protrusions rest snugly on the planar chamfered upstream surfaces of the corresponding latches;

wherein the outlet orifice of the ladle is in fluid communication with the through-opening of the top gate plate;

wherein the support frame is slidingly coupled to a planar bottom surface of the top gate plate, such that the opening of the bottom gate plate can be brought in or out of registry with the through-opening of the top gate plate, by means of a first hydraulic arm;

wherein the ladle shroud comprises:

(a) a bore extending parallel to a first longitudinal axis, X1, from an inlet orifice to an outlet orifice, (b) an inlet portion located at an upstream end of the ladle shroud and consisting of a plate comprising:

a planar upstream surface normal to said first longitudinal axis, X1, said upstream surface comprising said inlet orifice and being defined by an upstream perimeter, a downstream surface defined by a downstream perimeter and separated from the upstream surface by, a peripheral wall contiguous to both upstream and downstream perimeters defining the thickness of the plate at the level of the upstream perimeter, and comprising at least a first and a second gripping portions separated from each other by the bore, (c) a tubular portion extending along said first longitudinal axis, X1, from said downstream surface of the inlet portion to a downstream end, opposite to an upstream end, and where said outlet orifice is located, wherein, each of said first and second gripping portions of the peripheral wall comprises an upstream protrusion culminating at an upstream ridge separating a leading edge facing towards the upstream end of the ladle shroud from a trailing edge facing towards the downstream end of the ladle shroud, and protruding out beyond the whole peripheral wall of the corresponding gripping portion, said upstream protrusions extending parallel to the upstream surface and substantially symmetrically to one another with respect to the first longitudinal axis, X1, along the respective first and second gripping portions and wherein, said leading edge forms with a plane parallel to the upstream surface an angle, $\alpha 1$, and said trailing edge (3*d*) forms an angle, $\beta 1$, with a plane parallel to the upstream surface (2*u*), wherein $|\alpha 1| \geq |\beta 1|$, and wherein the distance separating the upstream ridge of the upstream protrusion of the first gripping portion from the one of the second gripping potion is equal to d+2Hd, wherein Hd is the distance from the upstream ridge of the upstream protrusion to the bottom of the trailing edge measured along a plane parallel to the upstream surface, said ladle shroud being releasable coupled to the drawer frame;

wherein the drawer frame is inserted in the T-passage of the support frame, such that the drawer frame can be moved back and forth through said T-passage along the first transverse axis, X2, by means of a second hydraulic arm; and wherein the first and second latches are mounted such that they can move from their coupling position, wherein they are separated from one another along the second transverse axis, X3, by a distance substantially equal to d, to their loading position, wherein they are separated from one another along the second transverse axis, X3, by a distance substantially equal to d+2Hd; and wherein the drawer frame, by moving through the T-passage of the support frame along the first transverse axis, X2, can bring alternatively the bore of the ladle shroud in and out of registry with the opening of the bottom gate plate, with the pushers pressing onto the downstream surface of the ladle shroud when the bore of the ladle shroud is in registry with the opening of the bottom gate plate.

14. Metal casting installation according to claim 13, wherein the drawer frame is loaded with a collector nozzle, such that moving said drawer frame through the passage of the support frame along the first transverse axis, X2, can bring alternatively the bore of the ladle shroud or the bore of the collector nozzle in and out of registry with the opening of the bottom gate plate.

15. Process for casting molten metal from a ladle into a tundish or other metallurgical vessel, the process utilizing a kit according to claim 7 and comprising the following steps:

(a) bringing a ladle containing molten metal and equipped with a support frame and a drawer frame, over a metallurgical vessel, wherein the support frame is configured to be coupled to the outer surface of the bottom floor of the ladle such that it can be slid from a sealed position to a casting position and back, said support frame comprising:

a top plate having a top planar surface normal to a longitudinal axis, X1, normal to both first and second transverse axes, X2, X3, and comprising an opening in which is snugly encased:

a bottom gate plate having a top surface slightly protruding above the top planar surface of the support frame and a bottom surface, parallel to said top surface and separated therefrom by the thickness of the bottom gate plate, said bottom gate plate being provided with an opening extending through the thickness of the bottom gate plate, parallel to the longitudinal axis, X1, and wherein when the support frame is coupled to the ladle, the top surface of the bottom gate plate is parallel to and in sliding contact with the bottom surface of the top gate plate, such that upon sliding the support frame from its sealed position to its casting position, the opening of the bottom gate plate is moved from a position wherein it is sealed from the through-opening of the top gate plate to a position where it is in fluid communication with the through opening of the top gate plate, two guiding rails extending along said first transverse axis, X2, and parallel to said top planar surface of the top plate, and separated from one another by a gap having a width measured along said second transverse axis, X3, which is smaller than the transverse width of the rectangle in which the external outline of the drawer frame is inscribed, and which is at least locally larger than the width measured along the second transverse axis, X3, of the cavity defined in the drawer frame;

a T-shaped passage extending from a frame inlet along the first transverse axis, X2, said passage being configured to accommodate the drawer frame and sliding it along the passage on the two guiding rails, two sets of pushers or rockers positioned adjacent to the two guiding rails on either side of the gap, at the level of the bottom gate plate opening, wherein the kit of parts further comprises a first latch and a second latch wherein, when the drawer frame is inserted in the passage of the support frame, said first and second latches, are facing one another on either side of the gap formed between the guiding rails, have a chamfered upstream surface forming an angle, β1, with a plane parallel to the first and second transverse axes, X2-X3, substantially equal to the angle, β1, formed by the trailing edge of the upstream protrusion of a ladle shroud, have a chamfered downstream surface forming an angle, α1, with a plane parallel to the first and second transverse axes, X2-X3, substantially equal to the angle, α1, formed by the leading edge of the upstream protrusion of a ladle shroud, and are movable back and forth along said second transverse axis, X3, from a coupling position, wherein the first and second latches are closest to one another and the upstream and downstream chamfered surfaces of the first and second latches protrude out in the gap between the two guiding rails, to a loading position, wherein the first and second latches are furthest apart and do not protrude in the gap between the two guiding rails, and are mounted on resilient latch drivers naturally biased to drive the latches in their coupling position, and wherein the drawer frame comprises two longitudinal beams extending along a first transverse axis, X2, separated from one another by two transverse beams, thus defining a cavity of area and perimeter suitable for snugly accommodating the equivalent of at least one upstream surface of a ladle shroud, the transverse and longitudinal beams being so arranged as to form an external outline which can be inscribed in a rectangle having a longitudinal length measured along a first transverse axis, X2, and a transverse width measured along a second transverse axis, X3, normal to the first transverse axis, X2, (b) using a handling tool, configured to hold a ladle shroud, to bring the ladle shroud below the support frame at the level of the latches, (c) with said handling tool forcing the inlet portion of the ladle shroud up into the cavity of the drawer frame through the latches by deforming the resilient latch driver until the latches engage and the ladle shroud reaches its coupled position, wherein the trailing edges of the first protrusions rest snugly on the planar chamfered upstream surface of each of the corresponding latches, (d) with a first hydraulic arm moving the drawer frame such as to bring the bore of the ladle shroud in registry with the opening of the bottom gate plate, with the pushers pressing onto the downstream surface of the ladle shroud, (e) with a second hydraulic arm moving the support frame into a casting position, such that the opening of the bottom gate plate is in registry with the through-opening of the top gate plate, such that molten metal contained in the ladle can flow through the ladle shroud.

16. Process according to claim 15 further comprising the following steps:

(a) when casting molten metal from the ladle is finished, moving the support frame with the second hydraulic arm to a sealed position such that the opening of the bottom gate plate is out of registry with the through-opening of the top gate plate, (b) moving the drawer frame with the first hydraulic arm such as to remove the ladle shroud from the pushers so that it hangs on the latches only, (c) with a robot or other handling tool, forcing the ladle shroud downwards through the latches by deforming the resilient means until the ladle nozzle is disengaged from the drawer frame and removing the ladle shroud; and (d) removing the ladle.

* * * * *